US010948273B2

(12) United States Patent
Burrow et al.

(10) Patent No.: US 10,948,273 B2
(45) **Date of Patent: *Mar. 16, 2021**

(54) MULTI-PIECE POLYMER AMMUNITION, CARTRIDGE AND COMPONENTS

(71) Applicant: True Velocity IP Holdings, LLC, Garland, TX (US)

(72) Inventors: Lonnie Burrow, Carrollton, TX (US); Christopher William Overton, Richardson, TX (US)

(73) Assignee: TRUE VELOCITY IP HOLDINGS, LLC, Garland, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/184,519

(22) Filed: Nov. 8, 2018

(65) Prior Publication Data

US 2020/0025537 A1 Jan. 23, 2020

Related U.S. Application Data

(62) Division of application No. 15/808,859, filed on Nov. 9, 2017.

(51) Int. Cl.

| | |
|---|---|
| ***F42B 5/307*** | (2006.01) |
| ***F42C 19/08*** | (2006.01) |
| ***F42B 5/313*** | (2006.01) |

(52) U.S. Cl.

CPC ..... *F42B 5/307* (2013.01); *F42B 5/313* (2013.01); *F42C 19/083* (2013.01)

(58) Field of Classification Search

CPC ..... F42B 5/307
USPC ..... 102/456–467
See application file for complete search history.

(56) References Cited

U.S. PATENT DOCUMENTS

| | | | |
|---|---|---|---|
| 99,528 | A | 2/1870 | Boyd |
| 113,634 | A | 4/1871 | Crispin |
| 130,679 | A | 8/1872 | Whitmore |
| 159,665 | A | 2/1875 | Gauthey |
| 169,807 | A | 11/1875 | Hart |
| 207,248 | A | 8/1878 | Bush et al. |
| 462,611 | A | 11/1891 | Comte de Sparre |
| 475,008 | A | 5/1892 | Bush |
| 498,856 | A | 6/1893 | Overbaugh |
| 640,856 | A | 1/1900 | Bailey |
| 662,137 | A | 11/1900 | Tellerson |

(Continued)

FOREIGN PATENT DOCUMENTS

| | | | |
|---|---|---|---|
| CA | 2813634 | A1 | 4/2012 |
| CN | 102901403 | B | 6/2014 |

(Continued)

OTHER PUBLICATIONS

International Ammunition Association, Inc. website, published on Apr. 2017, PCP Ammo Variation in U.S. Military Polymer/Metal Cartridge Case R&D, Available on the Internet URL https://forum.cartridgecollectors.org/t/pcp-ammo-variation-in-u-s-military-polyer-metal-cartridge-case-r-d/24400.

(Continued)

*Primary Examiner* — Reginald S Tillman, Jr.
(74) *Attorney, Agent, or Firm* — Singleton Law, PLLC; Chainey P. Singleton

(57) ABSTRACT

The present invention provides polymer ammunition, ammunition cartridge, ammunition case, and portions thereof having traditional and non-traditional cartridge shapes or profiles.

17 Claims, 6 Drawing Sheets

(56) References Cited

U.S. PATENT DOCUMENTS

| | | | |
|---|---|---|---|
| 676,000 | A | 6/1901 | Henneberg |
| 743,242 | A | 11/1903 | Bush |
| 865,979 | A | 9/1907 | Bailey |
| 869,046 | A | 10/1907 | Bailey |
| 905,358 | A | 12/1908 | Peters |
| 957,171 | A | 5/1910 | Loeb |
| 963,911 | A | 7/1910 | Loeble |
| 1,060,817 | A | 5/1913 | Clyne |
| 1,060,818 | A | 5/1913 | Clyne |
| 1,936,905 | A | 11/1933 | Gaidos |
| 1,940,657 | A | 12/1933 | Woodford |
| 2,294,822 | A | 9/1942 | Norman |
| 2,465,962 | A | 3/1949 | Allen et al. |
| 2,654,319 | A | 10/1953 | Roske |
| 2,823,611 | A | 2/1958 | Thayer |
| 2,862,446 | A | 12/1958 | Lars |
| 2,918,868 | A | 12/1959 | Lars |
| 2,953,990 | A | 9/1960 | Miller |
| 2,972,947 | A | 2/1961 | Fitzsimmons et al. |
| 3,099,958 | A | 8/1963 | Daubenspeck et al. |
| 3,159,701 | A | 12/1964 | Herter |
| 3,170,401 | A | 2/1965 | Johnson et al. |
| 3,171,350 | A | 3/1965 | Metcalf et al. |
| 3,242,789 | A | 3/1966 | Woodring |
| 3,292,538 | A | 12/1966 | Hans et al. |
| 3,332,352 | A | 7/1967 | Olson et al. |
| 3,485,170 | A | 12/1969 | Scanlon |
| 3,485,173 | A | 12/1969 | Morgan |
| 3,609,904 | A | 10/1971 | Scanlon |
| 3,659,528 | A | 5/1972 | Santala |
| 3,688,699 | A | 9/1972 | Horn et al. |
| 3,690,256 | A | 9/1972 | Schnitzer |
| 3,745,924 | A | 7/1973 | Scanlon |
| 3,749,021 | A | 7/1973 | Burgess |
| 3,756,156 | A | 9/1973 | Schuster |
| 3,765,297 | A | 10/1973 | Skochko et al. |
| 3,768,413 | A | 10/1973 | Ramsay |
| 3,797,396 | A | 3/1974 | Reed |
| 3,842,739 | A | 10/1974 | Scanlon et al. |
| 3,866,536 | A | 2/1975 | Greenberg |
| 3,874,294 | A | 4/1975 | Hale |
| 3,955,506 | A | 5/1976 | Luther et al. |
| 3,977,326 | A | 8/1976 | Anderson et al. |
| 3,990,366 | A | 11/1976 | Scanlon |
| 4,005,630 | A | 2/1977 | Patrick |
| 4,020,763 | A | 5/1977 | Iruretagoyena |
| 4,147,107 | A | 4/1979 | Ringdal |
| 4,157,684 | A | 6/1979 | Clausser |
| 4,173,186 | A | 11/1979 | Dunham |
| 4,187,271 | A | 2/1980 | Rolston et al. |
| 4,228,724 | A | 10/1980 | Leich |
| 4,276,830 | A | 7/1981 | Alice |
| 4,475,435 | A | 10/1984 | Mantel |
| 4,483,251 | A | 11/1984 | Spalding |
| 4,598,445 | A | 7/1986 | O'Connor |
| 4,614,157 | A | 9/1986 | Grelle et al. |
| 4,679,505 | A | 7/1987 | Reed |
| 4,718,348 | A | 1/1988 | Ferrigno |
| 4,719,859 | A | 1/1988 | Ballreich et al. |
| 4,726,296 | A | 2/1988 | Leshner et al. |
| 4,763,576 | A | 8/1988 | Kass et al. |
| 4,867,065 | A | 9/1989 | Kaltmann et al. |
| 4,970,959 | A | 11/1990 | Bilsbury et al. |
| 5,021,206 | A | 6/1991 | Stoops |
| 5,033,386 | A | 7/1991 | Vatsvog |
| 5,063,853 | A | 11/1991 | Bilgeri |
| 5,090,327 | A | 2/1992 | Bilgeri |
| 5,127,331 | A | 7/1992 | Stoops |
| 5,151,555 | A | 9/1992 | Vatsvog |
| 5,165,040 | A | 11/1992 | Andersson et al. |
| 5,237,930 | A | 8/1993 | Belanger et al. |
| 5,247,888 | A | 9/1993 | Conil |
| 5,259,288 | A | 11/1993 | Vatsvog |
| 5,265,540 | A | 11/1993 | Ducros et al. |
| D345,676 | S | 4/1994 | Biffle |
| 5,433,148 | A | 7/1995 | Barratault et al. |
| 5,535,495 | A | 7/1996 | Gutowski |
| 5,563,365 | A | 10/1996 | Dineen et al. |
| 5,616,642 | A | 4/1997 | West et al. |
| D380,650 | S | 7/1997 | Norris |
| 5,679,920 | A | 10/1997 | Hallis et al. |
| 5,770,815 | A | 6/1998 | Watson |
| 5,798,478 | A | 8/1998 | Beal |
| 5,950,063 | A | 9/1999 | Hens et al. |
| 5,961,200 | A | 10/1999 | Friis |
| 5,969,288 | A | 10/1999 | Baud |
| 6,004,682 | A | 12/1999 | Rackovan et al. |
| 6,048,379 | A | 4/2000 | Bray et al. |
| 6,070,532 | A | 6/2000 | Halverson |
| D435,626 | S | 12/2000 | Benini |
| 6,257,149 | B1 | 7/2001 | Cesaroni |
| D447,209 | S | 8/2001 | Benini |
| 6,272,993 | B1 | 8/2001 | Cook et al. |
| 6,283,035 | B1 | 9/2001 | Olson et al. |
| 6,357,357 | B1 | 3/2002 | Glasser |
| D455,052 | S | 4/2002 | Gullickson et al. |
| D455,320 | S | 4/2002 | Edelstein |
| 6,375,971 | B1 | 4/2002 | Hansen |
| 6,450,099 | B1 | 9/2002 | Desgland |
| 6,460,464 | B1 | 10/2002 | Attarwala |
| 6,523,476 | B1 | 2/2003 | Riess et al. |
| 6,649,095 | B2 | 11/2003 | Buja |
| 6,672,219 | B2 | 1/2004 | Mackerell et al. |
| 6,708,621 | B1 | 3/2004 | Forichon-Chaumet et al. |
| 6,752,084 | B1 | 6/2004 | Husseini et al. |
| 6,810,816 | B2 | 11/2004 | Rennard |
| 6,840,149 | B2 | 1/2005 | Beal |
| 6,845,716 | B2 | 1/2005 | Husseini et al. |
| 7,000,547 | B2 | 2/2006 | Amick |
| 7,014,284 | B2 | 3/2006 | Morton et al. |
| 7,032,492 | B2 | 4/2006 | Meshirer |
| 7,056,091 | B2 | 6/2006 | Powers |
| 7,059,234 | B2 | 6/2006 | Husseini |
| 7,159,519 | B2 | 1/2007 | Robinson et al. |
| 7,165,496 | B2 | 1/2007 | Reynolds |
| D540,710 | S | 4/2007 | Charrin |
| 7,204,191 | B2 | 4/2007 | Wiley et al. |
| 7,213,519 | B2 | 5/2007 | Wiley et al. |
| 7,231,519 | B2 | 6/2007 | Joseph et al. |
| 7,232,473 | B2 | 6/2007 | Elliott |
| 7,299,750 | B2 | 11/2007 | Schikora et al. |
| 7,353,756 | B2 | 4/2008 | Leasure |
| 7,380,505 | B1 | 6/2008 | Shiery |
| 7,383,776 | B2 | 6/2008 | Amick |
| 7,392,746 | B2 | 7/2008 | Hansen |
| 7,426,888 | B2 | 9/2008 | Hunt |
| 7,441,504 | B2 | 10/2008 | Husseini et al. |
| D583,927 | S | 12/2008 | Benner |
| 7,458,322 | B2 | 12/2008 | Reynolds et al. |
| 7,461,597 | B2 | 12/2008 | Brunn |
| 7,568,417 | B1 | 8/2009 | Lee |
| 7,585,166 | B2 | 9/2009 | Buja |
| 7,610,858 | B2 | 11/2009 | Chung |
| 7,750,091 | B2 | 7/2010 | Maljkovic et al. |
| D626,619 | S | 11/2010 | Gogol et al. |
| 7,841,279 | B2 | 11/2010 | Reynolds et al. |
| D631,699 | S | 2/2011 | Moreau |
| D633,166 | S | 2/2011 | Richardson et al. |
| 7,908,972 | B2 | 3/2011 | Brunn |
| 7,930,977 | B2 | 4/2011 | Klein |
| 8,007,370 | B2 | 8/2011 | Hirsch et al. |
| 8,056,232 | B2 | 11/2011 | Patel et al. |
| 8,156,870 | B2 | 4/2012 | South |
| 8,186,273 | B2 | 5/2012 | Trivette |
| 8,191,480 | B2 | 6/2012 | Mcaninch |
| 8,201,867 | B2 | 6/2012 | Thomeczek |
| 8,206,522 | B2 | 6/2012 | Sandstrom et al. |
| 8,220,393 | B2 | 7/2012 | Schluckebier et al. |
| 8,240,252 | B2 | 8/2012 | Maljkovic et al. |
| D675,882 | S | 2/2013 | Crockett |
| 8,393,273 | B2 | 3/2013 | Weeks et al. |
| 8,408,137 | B2 | 4/2013 | Battaglia |
| D683,419 | S | 5/2013 | Rebar |
| 8,443,729 | B2 | 5/2013 | Mittelstaedt |

(56) References Cited

U.S. PATENT DOCUMENTS 8,443,730 B2 5/2013 Padgett
8,464,641 B2 6/2013 Se-Hong
8,511,233 B2 8/2013 Nilsson
D689,975 S 9/2013 Carlson et al.
8,522,684 B2 9/2013 Davies et al.
8,540,828 B2 9/2013 Busky et al.
8,561,543 B2 10/2013 Burrow
8,573,126 B2 11/2013 Klein et al.
8,641,842 B2 2/2014 Hafner et al.
8,689,696 B1 4/2014 Seeman et al.
8,763,535 B2 7/2014 Padgett
8,790,455 B2 7/2014 Borissov et al.
8,807,008 B2 8/2014 Padgett et al.
8,807,040 B2 8/2014 Menefee, III
8,813,650 B2 8/2014 Maljkovic et al.
D715,888 S 10/2014 Padgett
8,850,985 B2 10/2014 Maljkovic et al.
8,857,343 B2 10/2014 Marx
8,869,702 B2 10/2014 Padgett
D717,909 S 11/2014 Thrift et al.
8,875,633 B2 11/2014 Padgett
8,893,621 B1 11/2014 Escobar
8,915,191 B2 12/2014 Jones
8,978,559 B2 3/2015 Davies et al.
8,985,023 B2 3/2015 Mason
9,003,973 B1 4/2015 Padgett
9,032,855 B1 5/2015 Foren et al.
9,091,516 B2 7/2015 Davies et al.
9,103,641 B2 8/2015 Nielson et al.
9,111,177 B2 8/2015 Tateno et al.
9,157,709 B2 10/2015 Nuetzman et al.
9,170,080 B2 10/2015 Poore et al.
9,182,204 B2 11/2015 Maljkovic et al.
9,188,412 B2 11/2015 Maljkovic et al.
9,200,157 B2 12/2015 El-Hibri et al.
9,200,878 B2 12/2015 Seecamp
9,200,880 B1 12/2015 Foren et al.
9,212,876 B1 12/2015 Kostka et al.
9,212,879 B2 12/2015 Whitworth
9,213,175 B2 12/2015 Arnold
9,254,503 B2 2/2016 Ward
9,255,775 B1 2/2016 Rubin
D752,397 S 3/2016 Seiders et al.
9,273,941 B2 3/2016 Carlson et al.
D754,223 S 4/2016 Pederson et al.
9,329,004 B2 5/2016 Pace
9,335,137 B2 5/2016 Maljkovic et al.
9,337,278 B1 5/2016 Gu et al.
9,347,457 B2 5/2016 Ahrens et al.
9,366,512 B2 6/2016 Burczynski et al.
9,372,054 B2 6/2016 Padgett
9,377,278 B2 6/2016 Rubin
9,389,052 B2 7/2016 Conroy et al.
9,395,165 B2 7/2016 Maljkovic et al.
D764,624 S 8/2016 Masinelli
D765,214 S 8/2016 Padgett
9,429,407 B2 8/2016 Burrow
9,441,930 B2 9/2016 Burrow
9,453,714 B2 9/2016 Bosarge et al.
D773,009 S 11/2016 Bowers
9,500,453 B2 11/2016 Schluckebier et al.
9,506,735 B1 11/2016 Burrow
D774,824 S 12/2016 Gallagher
9,513,092 B2 12/2016 Emary
9,513,096 B2 12/2016 Burrow
9,518,810 B1 12/2016 Burrow
9,523,563 B1 12/2016 Burrow
9,528,799 B2 12/2016 Maljkovic
9,546,849 B2 1/2017 Burrow
9,551,557 B1 1/2017 Burrow
D778,391 S 2/2017 Burrow
D778,393 S 2/2017 Burrow
D778,394 S 2/2017 Burrow
D778,395 S 2/2017 Burrow
D779,021 S 2/2017 Burrow
D779,024 S 2/2017 Burrow
D780,283 S 2/2017 Burrow
9,587,918 B1 3/2017 Burrow
9,599,443 B2 3/2017 Padgett et al.
9,625,241 B2 4/2017 Neugebauer
9,631,907 B2 4/2017 Burrow
9,644,930 B1 5/2017 Burrow
9,658,042 B2 5/2017 Emary
9,683,818 B2 6/2017 Lemke et al.
D792,200 S 7/2017 Baiz et al.
9,709,368 B2 7/2017 Mahnke
D797,880 S 9/2017 Seecamp
9,759,554 B2 9/2017 Ng et al.
D800,244 S 10/2017 Burczynski et al.
D800,245 S 10/2017 Burczynski et al.
D800,246 S 10/2017 Burczynski et al.
9,784,667 B2 10/2017 Lukay et al.
9,835,423 B2 12/2017 Burrow
9,835,427 B2 12/2017 Burrow
9,857,151 B2 1/2018 Dionne et al.
9,869,536 B2 1/2018 Burrow
9,879,954 B2 1/2018 Hajjar
9,885,551 B2 2/2018 Burrow
D813,975 S 3/2018 White
9,921,040 B2 3/2018 Rubin
9,927,219 B2 3/2018 Burrow
9,933,241 B2 4/2018 Burrow
9,939,236 B2 4/2018 Drobockyi et al.
9,964,388 B1 5/2018 Burrow
D821,536 S 6/2018 Christiansen et al.
9,989,339 B2 6/2018 Riess
9,989,343 B2 6/2018 Padgett et al.
10,041,770 B2 8/2018 Burrow
10,041,771 B1 8/2018 Burrow
10,041,776 B1 8/2018 Burrow
10,041,777 B1 8/2018 Burrow
10,048,049 B2 8/2018 Burrow
10,048,050 B1 8/2018 Burrow
10,048,052 B2 8/2018 Burrow
10,054,413 B1 8/2018 Burrow
D828,483 S 9/2018 Burrow
10,081,057 B2 9/2018 Burrow
D832,037 S 10/2018 Gallagher
10,101,140 B2 10/2018 Burrow
10,124,343 B2 11/2018 Tsai
10,145,662 B2 12/2018 Burrow
10,190,857 B2 1/2019 Burrow
10,254,096 B2 4/2019 Burrow
10,260,847 B2 4/2019 Viggiano et al.
D849,181 S 5/2019 Burrow
10,302,403 B2 5/2019 Burrow
10,302,404 B2 5/2019 Burrow
10,323,918 B2 6/2019 Menefee, III
10,330,451 B2 6/2019 Burrow
10,345,088 B2 7/2019 Burrow
10,352,664 B2 7/2019 Burrow
10,352,670 B2 7/2019 Burrow
10,359,262 B2 7/2019 Burrow
10,365,074 B2 * 7/2019 Burrow ..... F42C 19/083
D861,118 S 9/2019 Burrow
D861,119 S 9/2019 Burrow
10,408,582 B2 9/2019 Burrow
10,408,592 B2 9/2019 Boss et al.
10,415,943 B2 9/2019 Burrow
10,429,156 B2 10/2019 Burrow
10,458,762 B2 10/2019 Burrow
10,466,020 B2 11/2019 Burrow
10,466,021 B2 11/2019 Burrow
10,480,911 B2 11/2019 Burrow
10,480,912 B2 11/2019 Burrow
10,480,915 B2 11/2019 Burrow et al.
10,488,165 B2 11/2019 Burrow
10,533,830 B2 1/2020 Burrow et al.
10,571,228 B2 2/2020 Burrow
10,571,229 B2 2/2020 Burrow
10,571,230 B2 2/2020 Burrow
10,571,231 B2 2/2020 Burrow
10,578,409 B2 3/2020 Burrow
10,591,260 B2 3/2020 Burrow et al.

(56) References Cited

U.S. PATENT DOCUMENTS

| | | | |
|---|---|---|---|
| D882,019 | S | 4/2020 | Burrow et al. |
| D882,020 | S | 4/2020 | Burrow et al. |
| D882,021 | S | 4/2020 | Burrow et al. |
| D882,022 | S | 4/2020 | Burrow et al. |
| D882,023 | S | 4/2020 | Burrow et al. |
| D882,024 | S | 4/2020 | Burrow et al. |
| D882,025 | S | 4/2020 | Burrow et al. |
| D882,026 | S | 4/2020 | Burrow et al. |
| D882,027 | S | 4/2020 | Burrow et al. |
| D882,028 | S | 4/2020 | Burrow et al. |
| D882,029 | S | 4/2020 | Burrow et al. |
| D882,030 | S | 4/2020 | Burrow et al. |
| D882,031 | S | 4/2020 | Burrow et al. |
| D882,032 | S | 4/2020 | Burrow et al. |
| D882,033 | S | 4/2020 | Burrow et al. |
| D882,720 | S | 4/2020 | Burrow et al. |
| D882,721 | S | 4/2020 | Burrow et al. |
| D882,722 | S | 4/2020 | Burrow et al. |
| D882,723 | S | 4/2020 | Burrow et al. |
| D882,724 | S | 4/2020 | Burrow et al. |
| 10,612,896 | B2 | 4/2020 | Burrow |
| 10,612,897 | B2 | 4/2020 | Burrow et al. |
| D884,115 | S | 5/2020 | Burrow et al. |
| 10,663,271 | B2 | 5/2020 | Rogers |
| D886,231 | S | 6/2020 | Burrow et al. |
| D886,937 | S | 6/2020 | Burrow et al. |
| 10,677,573 | B2 | 6/2020 | Burrow et al. |
| D891,567 | S | 7/2020 | Burrow et al. |
| D891,568 | S | 7/2020 | Burrow et al. |
| D891,569 | S | 7/2020 | Burrow et al. |
| D891,570 | S | 7/2020 | Burrow et al. |
| 10,704,869 | B2 | 7/2020 | Burrow et al. |
| 10,704,870 | B2 | 7/2020 | Burrow et al. |
| 10,704,871 | B2 | 7/2020 | Burrow et al. |
| 10,704,872 | B1 | 7/2020 | Burrow et al. |
| 10,704,876 | B2 | 7/2020 | Boss et al. |
| 10,704,877 | B2 | 7/2020 | Boss et al. |
| 10,704,878 | B2 | 7/2020 | Boss et al. |
| 10,704,879 | B1 | 7/2020 | Burrow et al. |
| 10,704,880 | B1 | 7/2020 | Burrow et al. |
| D892,258 | S | 8/2020 | Burrow et al. |
| D893,665 | S | 8/2020 | Burrow et al. |
| D893,666 | S | 8/2020 | Burrow et al. |
| D893,667 | S | 8/2020 | Burrow et al. |
| D893,668 | S | 8/2020 | Burrow et al. |
| D894,320 | S | 8/2020 | Burrow et al. |
| 10,731,956 | B2 | 8/2020 | Burrow et al. |
| 10,731,957 | B1 | 8/2020 | Burrow et al. |
| 10,753,713 | B2 | 8/2020 | Burrow |
| 2003/0127011 | A1 | 7/2003 | Mackerell et al. |
| 2004/0074412 | A1 | 4/2004 | Kightlinger |
| 2005/0257712 | A1 | 11/2005 | Husseini et al. |
| 2006/0027125 | A1 | 2/2006 | Brunn |
| 2006/0278116 | A1 | 12/2006 | Hunt |
| 2006/0283345 | A1 | 12/2006 | Feldman et al. |
| 2007/0056343 | A1 | 3/2007 | Cremonesi |
| 2007/0181029 | A1 | 8/2007 | Mcaninch |
| 2007/0214993 | A1 | 9/2007 | Cerovic et al. |
| 2010/0234132 | A1 | 9/2010 | Hirsch et al. |
| 2011/0179965 | A1 | 7/2011 | Mason |
| 2012/0180685 | A1 | 7/2012 | Se-Hong |
| 2012/0291655 | A1 | 11/2012 | Jones |
| 2013/0014664 | A1 | 1/2013 | Padgett |
| 2013/0014665 | A1 | 1/2013 | Maljkovic et al. |
| 2013/0076865 | A1 | 3/2013 | Tateno et al. |
| 2013/0186294 | A1 | 7/2013 | Davies et al. |
| 2013/0291711 | A1 | 11/2013 | Mason |
| 2014/0260925 | A1 | 9/2014 | Beach et al. |
| 2014/0261044 | A1 | 9/2014 | Seecamp |
| 2014/0311332 | A1 | 10/2014 | Carlson et al. |
| 2015/0226220 | A1 | 8/2015 | Bevington |
| 2015/0268020 | A1 | 9/2015 | Emary |
| 2016/0003589 | A1 | 1/2016 | Burrow |
| 2016/0003590 | A1 | 1/2016 | Burrow |
| 2016/0003593 | A1 | 1/2016 | Burrow |
| 2016/0003594 | A1 | 1/2016 | Burrow |
| 2016/0003595 | A1 | 1/2016 | Burrow |
| 2016/0003596 | A1 | 1/2016 | Burrow |
| 2016/0003597 | A1 | 1/2016 | Burrow |
| 2016/0003601 | A1 | 1/2016 | Burrow |
| 2016/0033241 | A1 | 2/2016 | Burrow |
| 2016/0102030 | A1 | 4/2016 | Coffey et al. |
| 2016/0146585 | A1 | 5/2016 | Padgett |
| 2016/0245626 | A1 | 8/2016 | Drieling et al. |
| 2016/0349022 | A1 | 12/2016 | Burrow |
| 2016/0349023 | A1 | 12/2016 | Burrow |
| 2016/0349028 | A1 | 12/2016 | Burrow |
| 2016/0356588 | A1 | 12/2016 | Burrow |
| 2016/0377399 | A1 | 12/2016 | Burrow |
| 2017/0030690 | A1 | 2/2017 | Viggiano et al. |
| 2017/0080498 | A1 | 3/2017 | Burrow |
| 2017/0082409 | A1 | 3/2017 | Burrow |
| 2017/0082411 | A1 | 3/2017 | Burrow |
| 2017/0089673 | A1 | 3/2017 | Burrow |
| 2017/0089674 | A1 | 3/2017 | Burrow |
| 2017/0089675 | A1 | 3/2017 | Burrow |
| 2017/0089679 | A1 | 3/2017 | Burrow |
| 2017/0153099 | A9 | 6/2017 | Burrow |
| 2017/0205217 | A9 | 7/2017 | Burrow |
| 2017/0299352 | A9 | 10/2017 | Burrow |
| 2018/0066925 | A1 | 3/2018 | Skowron et al. |
| 2018/0106581 | A1 | 4/2018 | Rogers |
| 2018/0224252 | A1 | 8/2018 | O'Rourke |
| 2018/0224253 | A1 | 8/2018 | Burrow |
| 2018/0224256 | A1 | 8/2018 | Burrow |
| 2018/0259310 | A1 | 9/2018 | Burrow |
| 2018/0306558 | A1 | 10/2018 | Padgett et al. |
| 2019/0011232 | A1 | 1/2019 | Boss et al. |
| 2019/0011233 | A1 | 1/2019 | Boss et al. |
| 2019/0011234 | A1 | 1/2019 | Boss et al. |
| 2019/0011235 | A1 | 1/2019 | Boss et al. |
| 2019/0011236 | A1 | 1/2019 | Burrow |
| 2019/0011237 | A1 | 1/2019 | Burrow |
| 2019/0011238 | A1 | 1/2019 | Burrow |
| 2019/0011239 | A1 | 1/2019 | Burrow |
| 2019/0011240 | A1 | 1/2019 | Burrow |
| 2019/0011241 | A1 | 1/2019 | Burrow |
| 2019/0025019 | A1 | 1/2019 | Burrow |
| 2019/0025020 | A1 | 1/2019 | Burrow |
| 2019/0025021 | A1 | 1/2019 | Burrow |
| 2019/0025022 | A1 | 1/2019 | Burrow |
| 2019/0025023 | A1 | 1/2019 | Burrow |
| 2019/0025024 | A1 | 1/2019 | Burrow |
| 2019/0025025 | A1 | 1/2019 | Burrow |
| 2019/0025026 | A1 | 1/2019 | Burrow |
| 2019/0025035 | A1 | 1/2019 | Burrow |
| 2019/0025036 | A1 | 1/2019 | Burrow |
| 2019/0106364 | A1 | 4/2019 | James |
| 2019/0107375 | A1 | 4/2019 | Burrow |
| 2019/0137228 | A1 | 5/2019 | Burrow et al. |
| 2019/0137229 | A1 | 5/2019 | Burrow et al. |
| 2019/0137230 | A1 | 5/2019 | Burrow et al. |
| 2019/0137231 | A1 | 5/2019 | Burrow et al. |
| 2019/0137232 | A1 | 5/2019 | Burrow et al. |
| 2019/0137233 | A1 | 5/2019 | Burrow et al. |
| 2019/0137234 | A1 | 5/2019 | Burrow et al. |
| 2019/0137235 | A1 | 5/2019 | Burrow et al. |
| 2019/0137236 | A1 | 5/2019 | Burrow et al. |
| 2019/0137237 | A1 | 5/2019 | Burrow et al. |
| 2019/0137238 | A1 | 5/2019 | Burrow et al. |
| 2019/0137239 | A1 | 5/2019 | Burrow et al. |
| 2019/0137240 | A1 | 5/2019 | Burrow et al. |
| 2019/0137241 | A1 | 5/2019 | Burrow et al. |
| 2019/0137242 | A1 | 5/2019 | Burrow et al. |
| 2019/0137243 | A1 | 5/2019 | Burrow et al. |
| 2019/0137244 | A1 | 5/2019 | Burrow et al. |
| 2019/0170488 | A1 | 6/2019 | Burrow |
| 2019/0204050 | A1 | 7/2019 | Burrow |
| 2019/0204056 | A1 | 7/2019 | Burrow |
| 2019/0212117 | A1 | 7/2019 | Burrow |
| 2019/0242679 | A1 | 8/2019 | Viggiano et al. |
| 2019/0242682 | A1 | 8/2019 | Burrow |
| 2019/0242683 | A1 | 8/2019 | Burrow |
| 2019/0249967 | A1 | 8/2019 | Burrow et al. |

(56) References Cited

U.S. PATENT DOCUMENTS

| | | | |
|---|---|---|---|
| 2019/0257625 | A1 | 8/2019 | Burrow |
| 2019/0310058 | A1 | 10/2019 | Burrow |
| 2019/0310059 | A1 | 10/2019 | Burrow |
| 2019/0316886 | A1 | 10/2019 | Burrow |
| 2019/0360788 | A1 | 11/2019 | Burrow |
| 2019/0376773 | A1 | 12/2019 | Burrow |
| 2019/0376774 | A1 | 12/2019 | Boss et al. |
| 2019/0383590 | A1 | 12/2019 | Burrow |
| 2020/0011645 | A1 | 1/2020 | Burrow et al. |
| 2020/0011646 | A1 | 1/2020 | Burrow et al. |
| 2020/0025536 | A1 | 1/2020 | Burrow et al. |
| 2020/0025537 | A1 | 1/2020 | Burrow et al. |
| 2020/0033102 | A1 | 1/2020 | Burrow |
| 2020/0033103 | A1 | 1/2020 | Burrow et al. |
| 2020/0041239 | A1 | 2/2020 | Burrow |
| 2020/0049469 | A1 | 2/2020 | Burrow |
| 2020/0049470 | A1 | 2/2020 | Burrow |
| 2020/0049471 | A1 | 2/2020 | Burrow |
| 2020/0049472 | A1 | 2/2020 | Burrow |
| 2020/0049473 | A1 | 2/2020 | Burrow |
| 2020/0056872 | A1 | 2/2020 | Burrow |
| 2020/0109932 | A1 | 4/2020 | Burrow |
| 2020/0149853 | A1 | 5/2020 | Burrow |
| 2020/0158483 | A1 | 5/2020 | Burrow |
| 2020/0200512 | A1 | 6/2020 | Burrow |
| 2020/0200513 | A1 | 6/2020 | Burrow |
| 2020/0208948 | A1 | 7/2020 | Burrow |
| 2020/0208949 | A1 | 7/2020 | Burrow |
| 2020/0208950 | A1 | 7/2020 | Burrow |
| 2020/0225009 | A1 | 7/2020 | Burrow |
| 2020/0248998 | A1 | 8/2020 | Burrow |
| 2020/0248999 | A1 | 8/2020 | Burrow |
| 2020/0249000 | A1 | 8/2020 | Burrow |
| 2020/0256654 | A1 | 8/2020 | Burrow |
| 2020/0263967 | A1 | 8/2020 | Burrow et al. |

FOREIGN PATENT DOCUMENTS

| | | | |
|---|---|---|---|
| DE | 16742 | C | 1/1882 |
| EP | 2625486 | A4 | 8/2017 |
| FR | 1412414 | A | 10/1965 |
| GB | 783023 | A | 9/1957 |
| RU | 2172467 | C1 | 8/2001 |
| WO | 0034732 | | 6/2000 |
| WO | 2007014024 | A2 | 2/2007 |
| WO | 2012047615 | A1 | 4/2012 |
| WO | 2012097320 | A1 | 7/2012 |
| WO | 2012097317 | A3 | 11/2012 |
| WO | 2013070250 | A1 | 5/2013 |
| WO | 2013096848 | A1 | 6/2013 |
| WO | 2014062256 | A2 | 4/2014 |
| WO | 2016003817 | A1 | 1/2016 |
| WO | 2019094544 | A1 | 5/2019 |
| WO | 2019160742 | A2 | 8/2019 |

OTHER PUBLICATIONS

Luck Gunner.com, Review: Polymer Cased Rifle Ammunition from PCP Ammo, Published Jan. 6, 2014, Available on the Internet URL https://www.luckygunner.com/lounge/pcp-ammo-review.

YouTube.com—TFB TV, Published on Jul. 23, 2015, available on Internal URL https://www.youtubecom/watch?v=mCjNkbxHkEE.

AccurateShooter.com Daily Bulletin "New PolyCase Ammunition and Injection-Molded Bullets" Jan. 11, 2015.

Korean Intellectual Property Office (ISA), International Search Report and Written Opinion for PCT/US2011/062781 dated Nov. 30, 2012, 16 pp.

Korean Intellectual Property Office (ISA), International Search Report and Written Opinion for PCT/US2015/038061 dated Sep. 21, 2015, 28 pages.

International Search Report and Written Opinion for PCTUS201859748 dated Mar. 1, 2019, pp. 1-9.

International Search Report and Written Opinion for PCTUS2019017085 dated Apr. 19, 2019, pp. 1-9.

International Preliminary Report on Patentability and Written Opinion in PCT/US2018/059748 dated May 12, 2020; pp. 1-8.

International Search Report and Written Opinion in PCT/US2019/040323 dated Sep. 24, 2019, pp. 1-16.

International Search Report and Written Opinion in PCT/US2019/040329 dated Sep. 27, 2019, pp. 1-24.

* cited by examiner

MULTI-PIECE POLYMER AMMUNITION, CARTRIDGE AND COMPONENTS

CROSS-REFERENCE TO RELATED APPLICATIONS

This application is a Divisional Application of co-pending U.S. patent application Ser. No. 15/808,859 filed on Nov. 9, 2017, and claims the benefit of U.S. patent application Ser. No. 29/644,794 filed on Apr. 20, 2018, and claims the benefit of U.S. patent application Ser. No. 29/644,797 filed Apr. 20, 2018, and claims the benefit of U.S. patent application Ser. No. 29/644,798 filed Apr. 20, 2018, and claims the benefit of U.S. patent application Ser. No. 29/644,805 filed Apr. 20, 2018, and claims the benefit of U.S. patent application Ser. No. 29/644,808 filed Apr. 20, 2018, and claims the benefit of U.S. patent application Ser. No. 29/644,810 filed Apr. 20, 2018, and claims the benefit of U.S. patent application Ser. No. 29/644,811 filed Apr. 20, 2018, and claims the benefit of U.S. patent application Ser. No. 29/644,816 filed Apr. 20, 2018, and claims the benefit of U.S. patent application Ser. No. 29/644,820 filed Apr. 20, 2018, and claims the benefit of U.S. patent application Ser. No. 29/644,824 filed Apr. 20, 2018, and claims the benefit of U.S. patent application Ser. No. 29/644,825 filed Apr. 20, 2018, and claims the benefit of U.S. patent application Ser. No. 29/644,828 filed Apr. 20, 2018, and claims the benefit of U.S. patent application Ser. No. 29/644,831 filed Apr. 20, 2018, and claims the benefit of U.S. patent application Ser. No. 29/644,835 filed Apr. 20, 2018, and claims the benefit of U.S. patent application Ser. No. 29/644,838 filed Apr. 20, 2018, and claims the benefit of U.S. patent application Ser. No. 29/644,842 filed Apr. 20, 2018, and claims the benefit of U.S. patent application Ser. No. 29/644,843 filed Apr. 20, 2018, and claims the benefit of U.S. patent application Ser. No. 29/644,844 filed Apr. 20, 2018, and claims the benefit of U.S. patent application Ser. No. 29/644,847 filed Apr. 20, 2018, and claims the benefit of U.S. patent application Ser. No. 29/644,849 filed Apr. 20, 2018, and claims the benefit of U.S. patent application Ser. No. 29/644,853 filed Apr. 20, 2018, and claims the benefit of U.S. patent application Ser. No. 29/644,855 filed Apr. 20, 2018. and claims the benefit of U.S. patent application Ser. No. 29/644,859 filed Apr. 20, 2018, and claims the benefit of U.S. patent application Ser. No. 29/644,862 filed Apr. 20, 2018, and claims the benefit of U.S. patent application Ser. No. 29/644,863 filed Apr. 20, 2018, and claims the benefit of U.S. patent application Ser. No. 29/644,864 filed Apr. 20, 2018, and claims the benefit of U.S. patent application Ser. No. 29/644,865 filed Apr. 20, 2018, and claims the benefit of U.S. patent application Ser. No. 29/644,867 filed Apr. 20, 2018, and claims the benefit of U.S. patent application Ser. No. 29/644,869 filed Apr. 20, 2018, and claims the benefit of U.S. patent application Ser. No. 29/646,297 filed May 3, 2018, and claims the benefit of U.S. patent application Ser. No. 29/646,298 filed May 3, 2018, and claims the benefit of U.S. patent application Ser. No. 29/646,299 filed May 3, 2018, and claims the benefit of U.S. patent application Ser. No. 29/646,300 filed May 3, 2018, the contents of each are hereby incorporated by reference in their entirety.

TECHNICAL FIELD OF THE INVENTION

The present invention relates in general to the field of ammunition, specifically to compositions of matter and methods of making and using polymeric ammunition cartridge casings having at least 2 portions.

STATEMENT OF FEDERALLY FUNDED RESEARCH

None.

INCORPORATION-BY-REFERENCE OF MATERIALS FILED ON COMPACT DISC

None.

BACKGROUND ART

Without limiting the scope of the invention, its background is described in connection with lightweight polymer cartridge casing ammunition. Conventional ammunition cartridge casings for rifles and machine guns, as well as larger caliber weapons, are made from brass, which is heavy, expensive, and potentially hazardous. There exists a need for an affordable lighter weight replacement for brass ammunition cartridge cases that can increase mission performance and operational capabilities. Lightweight polymer cartridge casing ammunition must meet the reliability and performance standards of existing fielded ammunition and be interchangeable with brass cartridge casing ammunition in existing weaponry. Reliable cartridge casings manufacture requires uniformity (e.g., bullet seating, bullet-to-casing fit, casing strength, etc.) from one cartridge to the next in order to obtain consistent pressures within the casing during firing prior to bullet and casing separation to create uniformed ballistic performance. Plastic cartridge casings have been known for many years but have failed to provide satisfactory ammunition that could be produced in commercial quantities with sufficient safety, ballistic, handling characteristics, and survive physical and natural conditions to which it will be exposed during the ammunition's intended life cycle; however, these characteristics have not been achieved.

Shortcomings of the known methods of producing plastic or substantially plastic ammunition include the possibility of the projectile being pushed into the cartridge casing, the bullet being held too light such that the bullet can fall out, the bullet being held insufficient to create sufficient chamber pressure, the bullet pull not being uniform from round to round, and the cartridge not being able to maintain the necessary pressure, portions of the cartridge casing breaking off upon firing causing the weapon to jam or damage or danger when subsequent rounds are fired or when the casing portions themselves become projectiles. To overcome the above shortcomings, improvements in cartridge case design and performance polymer materials are needed.

DISCLOSURE OF THE INVENTION

The present invention provides a nose for an ammunition cartridge comprising: a generally cylindrical neck having a projectile aperture at a first end; a shoulder comprising a shoulder top connected to the generally cylindrical neck that extends to a shoulder bottom; a nose junction positioned around the shoulder bottom, wherein the nose junction comprises a half lap junction having a groove adjacent to a skirt adapted to mate to a base junction in an ammunition cartridge, wherein the skirt is positioned on the inside of the nose and extends away from the shoulder bottom.

The present invention provides a multi piece ammunition cartridge comprising: an primer insert comprising a top surface opposite a bottom surface and a substantially cylindrical coupling element that extends from the bottom surface, a primer recess in the top surface that extends toward the bottom surface, a primer flash hole aperture positioned in the primer recess to extend through the bottom surface, and a groove positioned around the primer flash hole aperture in the primer recess; a middle body comprising a body extending from a body half lap junction to the primer insert, wherein the body is molded at least partially the primer insert by molding over the cylindrical coupling element and into the primer flash hole aperture and into the groove to form a primer flash hole; and a nose connected to the middle body, wherein the nose comprises a generally cylindrical neck having a projectile aperture at a first end; a shoulder comprising a shoulder top connected to the generally cylindrical neck that extends to a shoulder bottom; a nose junction positioned around the shoulder bottom, wherein the nose junction comprises a half lap junction having a groove adjacent to a skirt adapted to mate to the body half lap junction to form an ammunition cartridge, wherein a propellant chamber is formed between the projectile aperture and the primer flash hole.

The present invention provides a method of making a multi piece ammunition cartridge comprising: providing an primer insert comprising a top surface opposite a bottom surface and a substantially cylindrical coupling element that extends from the bottom surface, a primer recess in the top surface that extends toward the bottom surface, a primer flash hole aperture positioned in the primer recess to extend through the bottom surface, and a groove positioned around the primer flash hole aperture in the primer recess; forming a middle body by overmolding the primer insert wherein the middle body comprising a body extending from a body half lap junction to the primer insert, wherein the body is molded at least partially the primer insert by molding over the cylindrical coupling element and into the primer flash hole aperture and into the groove to form a primer flash hole; connecting a nose to the middle body, wherein the nose comprises a generally cylindrical neck having a projectile aperture at a first end; a shoulder comprising a shoulder top connected to the generally cylindrical neck that extends to a shoulder bottom; a nose junction positioned around the shoulder bottom, wherein the nose junction comprises a half lap junction having a groove adjacent to a skirt adapted to mate to the body half lap junction to form an ammunition cartridge, and a propellant chamber is formed between the projectile aperture and the primer flash hole.

The present invention provides a multi piece ammunition cartridge comprising: an primer insert comprising a top surface opposite a bottom surface and a substantially cylindrical coupling element that extends from the bottom surface, a primer recess in the top surface that extends toward the bottom surface, a primer flash hole aperture positioned in the primer recess to extend through the bottom surface, and a groove positioned around the primer flash hole aperture in the primer recess; a middle body comprising a body extending from a body half lap junction to the primer insert, wherein the body is molded at least partially the primer insert by molding over the cylindrical coupling element and into the primer flash hole aperture and into the groove to form a primer flash hole; and a shortened neck having a projectile aperture at a first end, wherein the shortened neck is reduced by 25-100% of the neck height of a standard cartridge neck; a shoulder comprising a shoulder top connected to the shortened neck that extends to a shoulder bottom; a nose junction positioned adjacent to the shoulder bottom, wherein the nose junction comprises a half lap junction having a groove adjacent to a skirt adapted to mate to the body half lap junction to form an ammunition cartridge, wherein a propellant chamber is formed between the projectile aperture and the primer flash hole.

The present invention provides a nose for an ammunition cartridge comprising: a shortened neck having a projectile aperture at a first end, wherein the shortened neck is reduced by 25-100% of the neck height of a standard cartridge neck; a shoulder comprising a shoulder top connected to the shortened neck that extends to a shoulder bottom; a nose junction positioned adjacent to the shoulder bottom, wherein the nose junction comprises a half lap junction having a groove adjacent to a skirt adapted to mate to a base junction in an ammunition cartridge, wherein the skirt is positioned on the inside of the nose and extends away from the shoulder bottom.

The present invention provides an ammunition cartridge having a reduced neck height comprising: a shortened neck having a projectile aperture, wherein the shortened neck is reduced by 25-100% of the neck height of a standard cartridge neck; a shoulder extending from the shortened neck to a cartridge side wall; wherein the cartridge side wall extends from the shoulder to the base to form an interior propellant chamber; wherein the base comprises an extraction ring, a primer recess positioned in the base in communication with the propellant chamber through a flash hole that extends from the primer recess into the propellant chamber.

The present invention provides that any of the embodiments may include a nose comprising a polymer, a metal an alloy or a combination thereof. The present invention provides that any of the embodiments may include a middle body comprising a polymer, a metal an alloy or a combination thereof. The polymer may be a single polymer, a mixture of 2 or more polymers, a blend of 2 or more polymers, or copolymerization of multiple polymers. In addition, the polymers may be doped. The polymer comprises comprise one or more polymers selected from the group consisting of polyurethane prepolymer, cellulose, fluoro-polymer, ethylene inter-polymer alloy elastomer, ethylene vinyl acetate, nylon, polyether imide, polyester elastomer, polyester sulfone, polyphenyl amide, polypropylene, polyvinylidene fluoride or thermoset polyurea elastomer, acrylics, homopolymers, acetates, copolymers, acrylonitrile-butadinen-styrene, thermoplastic fluoro polymers, inomers, polyamides, polyamide-imides, polyacrylates, polyatherketones, polyaryl-sulfones, polybenzimidazoles, polycarbonates, polybutylene, Polybutylene terephthalate, terephthalates, polyether imides, polyether sulfones, thermoplastic polyimides, thermoplastic polyurethanes, polyphenylene sulfides, polyethylene, polypropylene, polysulfones, polyvinylchlorides, styrene acrylonitriles, polystyrenes, polyphenylene, ether blends, styrene maleic anhydrides, polycarbonates, allyls, aminos, cyanates, epoxies, phenolics, unsaturated polyesters, bismaleimides, polyurethanes, silicones, vinylesters, urethane hybrids, polyphenylsulfones, copolymers of polyphenylsulfones with polyethersulfones or polysulfones, copolymers of poly-phenylsulfones with siloxanes, blends of polyphenylsulfones with polysiloxanes, poly(etherimide-siloxane) copolymers, blends of polyetherimides and polysiloxanes, and blends of polyetherimides and poly(etherimide-siloxane) copolymers.

The present invention provides that any of the embodiments may include a skirt adapted to flushly mate to a body half lap junction in an ammunition cartridge. However the overlapping junctions of the skirt and the middle body do not have to fit flush and may have a protrusion by the nose skirt or the mating middle body skirt. The present invention provides that any of the embodiments may include an angle formed between the groove and the skirt is between 40 and 140 degrees, between 80 and 110 degrees or between 85 and 95 degrees or about 90 degrees. Although the angle may be any angle between 0-180 degrees, e.g., 0, 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, 50, 51, 52, 53, 54, 55, 56, 57, 58, 59, 60, 61, 62, 63, 64, 65, 66, 67, 68, 69, 70, 71, 72, 73, 74, 75, 76, 77, 78, 79, 80, 81, 82, 83, 84, 85, 86, 87, 88, 89, 90, 91, 92, 93, 94, 95, 96, 97, 98, 99, 100, 101, 102, 103, 104, 105, 106, 107, 108, 109, 110, 111, 112, 113, 114, 115, 116, 117, 118, 119, 120, 121, 122, 123, 124, 125, 126, 127, 128, 129, 130, 131, 132, 133, 134, 135, 136, 137, 138, 139, 140, 141, 142, 143, 144, 145, 146, 147, 148, 149, 150, 151, 152, 153, 154, 155, 156, 157, 158, 159, 160, 161, 162, 163, 164, 165, 166, 167, 168, 169, 170, 171, 172, 173, 174, 175, 176, 177, 178, 179, 180 and incremental variations thereof.

The present invention provides that any of the embodiments may include a shoulder angle on the outside that is not mirrored on the shoulder on the inside. For example, the present invention provides that any of the embodiments may include a generally cylindrical neck comprising an interior neck positioned opposite the generally cylindrical neck and an interior shoulder connected to the interior neck extending opposite the shoulder, wherein an exterior shoulder angle is from the generally cylindrical neck to the shoulder and an interior shoulder angle is from the interior neck to the interior shoulder; and the interior shoulder angle is greater than the exterior shoulder angle. In addition, the interior shoulder and the exterior shoulder may not be a single angle or radius but multiple straight and curved segments connected together. For example, the present invention provides that any of the embodiments may include the interior shoulder further comprising a parallel region that is parallel to the exterior shoulder and a nonparallel region that is not parallel to the exterior shoulder.

The present invention provides that any of the embodiments may include a nose adapted to fit a 5.56 mm, 7.62 mm, 12.7 mm, 14.5 mm, .223, .243, .277, .300, .308, .338, or a .50 caliber projectile. Similarly, the nose may mate to a middle body of a 5.56 mm, 7.62 mm, 12.7 mm, 14.5 mm, .223, .243, .277, .300, .308, .338, or a .50 caliber ammunition cartridge.

The present invention provides that any of the embodiments may include a shortened neck that is reduced by 5 to 100% compared to the neck of a conventional ammunition cartridge, e.g., 5%, 6%, 7%, 8%, 9%, 10%, 11%, 12%, 13%, 14%, 15%, 16%, 17%, 18%, 19%, 20%, 21%, 22%, 23%, 24%, 25%, 26%, 27%, 28%, 29%, 30%, 31%, 32%, 33%, 34%, 35%, 36%, 37%, 38%, 39%, 40%, 41%, 42%, 43%, 44%, 45%, 46%, 47%, 48%, 49%, 50%, 51%, 52%, 53%, 54%, 55%, 56%, 57%, 58%, 59%, 60%, 61%, 62%, 63%, 64%, 65%, 66%, 67%, 68%, 69%, 70%, 71%, 72%, 73%, 74%, 75%, 76%, 77%, 78%, 79%, 80%, 81%, 82%, 83%, 84%, 85%, 86%, 87%, 88%, 89%, 90%, 91%, 92%, 93%, 94%, 95%, 96%, 97%, 98%, 99%, 100% and incremental variations thereof.

The present invention provided polymer ammunition cases (cartridges) injection molded over a primer insert and methods of making thereof. The present invention provided polymer ammunition noses that mate to the polymer ammunition cases to be loaded to make polymer ammunition and methods of making thereof.

DESCRIPTION OF THE DRAWINGS

For a more complete understanding of the features and advantages of the present invention, reference is now made to the detailed description of the invention along with the accompanying figures and in which:

FIGS. 42A, 42C, 42D and 42E depict a side, cross-sectional view of a nontraditional ammunition cartridges, while

DESCRIPTION OF EMBODIMENTS

Figure 1:
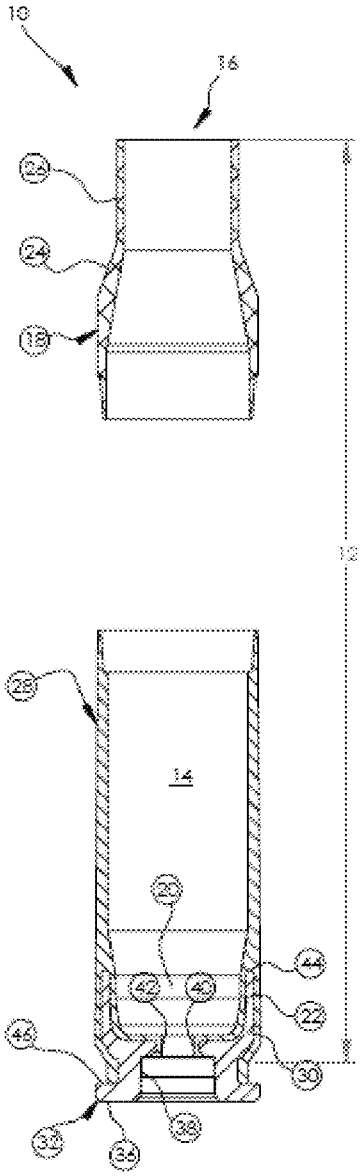
FIG. 1 depicts a side, cross-sectional view of a polymeric cartridge case according to one embodiment of the present invention.

While the making and using of various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention.

To facilitate the understanding of this invention, a number of terms are defined below. Terms defined herein have meanings as commonly understood by a person of ordinary skill in the areas relevant to the present invention. Terms such as "a", "an" and "the" are not intended to refer to only a singular entity, but include the general class of which a specific example may be used for illustration. The terminology herein is used to describe specific embodiments of the invention, but their usage does not delimit the invention, except as outlined in the claims.

Reliable cartridge manufacture requires uniformity from one cartridge to the next in order to obtain consistent ballistic performance. Among other considerations, proper bullet seating and bullet-to-casing fit is required. In this manner, a desired pressure develops within the casing during firing prior to bullet and casing separation. Historically, bullets employ a cannelure, which is a slight annular depression formed in a surface of the bullet at a location determined to be the optimal seating depth for the bullet. In this manner, a visual inspection of a cartridge could determine whether or not the bullet is seated at the proper depth. Once the bullet is inserted into the casing to the proper depth, one of two standard procedures is incorporated to lock the bullet in its proper location. One method is the crimping of the entire end of the casing into the cannelure. A second method does not crimp the casing end; rather the bullet is pressure fitted into the casing.

The polymeric ammunition cartridges of the present invention are of a caliber typically carried by soldiers in combat for use in their combat weapons. The present invention is not limited to the described caliber and is believed to be applicable to other calibers as well. This includes various small and medium caliber munitions, including 5.45 mm, 5.56 mm, 6.5 mm, 6.8 mm, 7 mm, 7.62 mm, 8 mm, 9 mm, 10 mm, 12.7 mm, 14.5 mm, 20 mm, 25 mm, 30 mm, 40 mm, .22, .22-250, .223, .243, .25-06, .270, .277, .300, .30-30, .30-40, 3.06, .300, .303, .308, .338, .357, .38, .380, .40, .44, .45, .45-70, .50 BMG caliber ammunition, cases, cartridges and components of ammunition, cases, cartridges. The ammunition and ammunition cartridge as well as the nose and base used to assemble the ammunition and the cartridge has a standardized size, shape and dimensions based on the caliber and chamber of the gun in which it is chambered. The chamber and the ammunition mate such that they have the same characteristics. The specific neck, shoulder, case diameter projectile aperture, and case length are known to the skilled and those standard measurements are available and known. In other embodiments of the instant application, the ammunition and ammunition cartridge as well as the nose and base used to assemble the ammunition and the cartridge have a nonstandardized size, shape and dimensions as described and illustrated herein.

FIG. 1 depicts a side, cross-sectional view of a polymeric cartridge case according to one embodiment of the present invention. A cartridge 10 suitable for use with high velocity rifles is shown manufactured with a polymer casing 12 showing a powder chamber 14 with projectile (not shown) inserted into the forward end opening 16. Polymer casing 12 has a substantially cylindrical open-ended polymeric bullet-end 18 extending from forward end opening 16 rearward to opposite end 20. The bullet-end component 18 may be formed with coupling end 22 formed on end 20. Coupling end 22 is shown as a female element, but may also be configured as a male element in alternate embodiments of the invention. The forward end of bullet-end component 18 has a shoulder 24 forming chamber neck 26. The bullet-end component typically has a wall thickness between about 0.003 and about 0.200 inches and more preferably between about 0.005 and more preferably between about 0.150 inches about 0.010 and about 0.050 inches.

The middle body component 28 is connected to a substantially cylindrical coupling element 30 of the substantially cylindrical insert 32. Coupling element 30, as shown may be configured as a male element, however, all combinations of male and female configurations is acceptable for coupling elements 30 and coupling end 22 in alternate embodiments of the invention. Coupling end 22 of bullet-end component 18 fits about and engages coupling element 30 of a substantially cylindrical insert 32. The substantially cylindrical insert 32 includes a substantially cylindrical coupling element 30 extending from a bottom surface 34 that is opposite a top surface 36. Located in the top surface 36 is a primer recess 38 that extends toward the bottom surface 34. A primer flash hole 40 is located in the primer flash hole 40 and extends through the bottom surface 34 into the powder chamber 14. The coupling end 22 extends the polymer through the primer flash hole 40 to form an aperture coating 42 while retaining a passage from the top surface 36 through the bottom surface 34 and into the powder chamber 14 to provide support and protection about the primer flash hole 40. When contacted the coupling end 22 interlocks with the substantially cylindrical coupling element 30, through the coupling element 30 that extends with a taper to a smaller diameter at the tip 44 to form a physical interlock between substantially cylindrical insert 32 and middle body component 28. Polymer casing 12 also has a substantially cylindrical open-ended middle body component 28. The middle body component extends from a forward end opening 16 to coupling element 22. The middle body component typically has a wall thickness between about 0.003 and about 0.200 inches and more preferably between about 0.005 and more preferably between about 0.150 inches about 0.010 and about 0.050 inches.

The bullet-end 16, middle body 18 and bottom surface 34 define the interior of powder chamber 14 in which the powder charge (not shown) is contained. The interior volume of powder chamber 14 may be varied to provide the volume necessary for complete filling of the chamber 14 by the propellant chosen so that a simplified volumetric measure of propellant can be utilized when loading the cartridge. Either a particulate or consolidated propellant can be used.

The substantially cylindrical insert 32 also has a flange 46 cut therein and a primer recess 38 formed therein for ease of insertion of the primer (not shown). The primer recess 38 is sized so as to receive the primer (not shown) in an interference fit during assembly. A primer flash hole 40 communicates through the bottom surface 34 of substantially cylindrical insert 32 into the powder chamber 14 so that upon detonation of primer (not shown) the powder in powder chamber 14 will be ignited.

Projectile (not shown) is held in place within chamber case neck 26 at forward opening 16 by an interference fit. Mechanical crimping of the forward opening 16 can also be applied to increase the bullet pull force. The bullet (not shown) may be inserted into place following the completion of the filling of powder chamber 14. Projectile (not shown) can also be injection molded directly onto the forward opening 16 prior to welding or bonding together using solvent, adhesive, spin-welding, vibration-welding, ultrasonic-welding or laser-welding techniques. The welding or bonding increases the joint strength so the casing can be extracted from the hot gun casing after firing at the cook-off temperature.

The bullet-end and bullet components can then be welded or bonded together using solvent, adhesive, spin-welding, vibration-welding, ultrasonic-welding or laser-welding techniques. The welding or bonding increases the joint strength so the casing can be extracted from the hot gun casing after firing at the cook-off temperature. An optional first and second annular grooves (cannelures) may be provided in the bullet-end in the interlock surface of the male coupling element to provide a snap-fit between the two components. The cannelures formed in a surface of the bullet at a location determined to be the optimal seating depth for the bullet. Once the bullet is inserted into the casing to the proper depth to lock the bullet in its proper location. One method is the crimping of the entire end of the casing into the cannelures.

The bullet-end and middle body components can then be welded or bonded together using solvent, adhesive, spin-welding, vibration-welding, ultrasonic-welding or laser-welding techniques. The welding or bonding increases the joint strength so the casing can be extracted from the hot gun casing after firing at the cook-off temperature.

Figure 2:
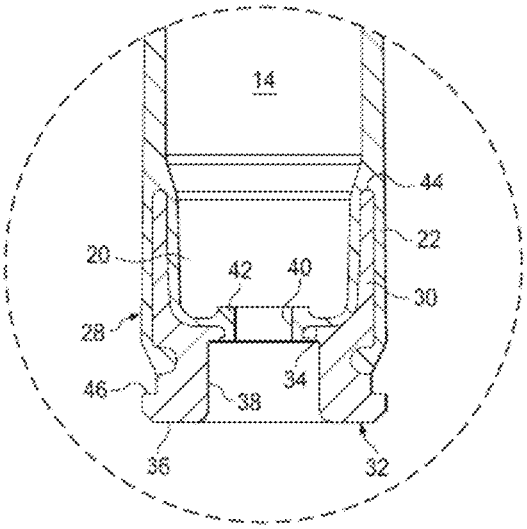
FIG. 2 depicts a side, cross-sectional view of a portion of the polymeric cartridge case according to one embodiment of the present invention.

FIG. 2 depicts a side, cross-sectional view of a portion of the polymeric cartridge case according to one embodiment of the present invention. A portion of a cartridge suitable for use with high velocity rifles is shown manufactured with a polymer casing 12 showing a powder chamber 14. Polymer casing 12 has a substantially cylindrical opposite end 20. The bullet-end component 18 may be formed with coupling end 22 formed on end 20. Coupling end 22 is shown as a female element, but may also be configured as a male element in alternate embodiments of the invention. The middle body component (not shown) is connected to a substantially cylindrical coupling element 30 of the substantially cylindrical insert 32. Coupling element 30, as shown may be configured as a male element, however, all combinations of male and female configurations is acceptable for coupling elements 30 and coupling end 22 in alternate embodiments of the invention. Coupling end 22 fits about and engages coupling element 30 of a substantially cylindrical insert 32. The substantially cylindrical insert 32 includes a substantially cylindrical coupling element 30 extending from a bottom surface 34 that is opposite a top surface 36. Located in the top surface 36 is a primer recess 38 that extends toward the bottom surface 34. A primer flash hole 40 is located in the primer recess 28 and extends through the bottom surface 34 into the powder chamber 14. The coupling end 22 extends the polymer through the primer flash hole 40 to form an aperture coating 42 while retaining a passage from the top surface 36 through the bottom surface 34 and into the powder chamber 14 to provide support and protection about the primer flash hole 40. When contacted the coupling end 22 interlocks with the substantially cylindrical coupling element 30, through the coupling element 30 that extends with a taper to a smaller diameter at the tip 44 to form a physical interlock between substantially cylindrical insert 32 and middle body component 28. Polymer casing 12 also has a substantially cylindrical open-ended middle body component 28.

Figure 3:
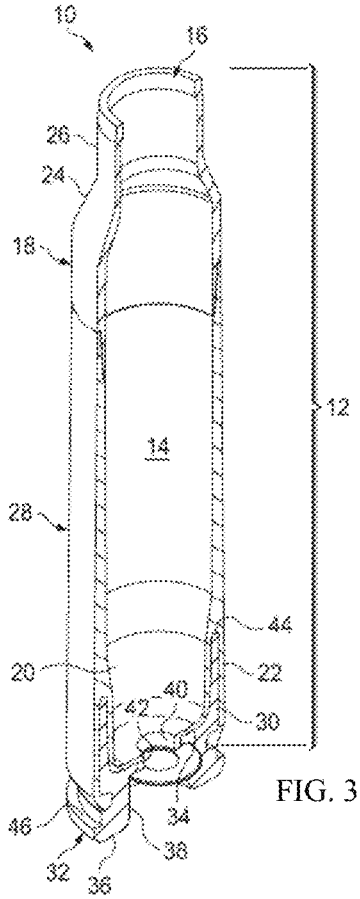
FIG. 3 depicts a side, cross-sectional view of a polymeric cartridge case having a diffuser according to one embodiment of the present invention.

FIG. 3 depicts a side, cross-sectional view of a polymeric cartridge case having a diffuser according to one embodiment of the present invention. The diffuser 50 is a device that is used to divert the affects of the primer off of the polymer and directing it to the flash hole. The affects being the impact from igniting the primer as far as pressure and heat. A cartridge 10 suitable for use with high velocity rifles is shown manufactured with a polymer casing 12 showing a powder chamber 14 with projectile (not shown) inserted into the forward end opening 16. Polymer casing 12 has a substantially cylindrical open-ended polymeric bullet-end 18 extending from forward end opening 16 rearward to the opposite end 20. The bullet-end component 18 may be formed with coupling end 22 formed on end 20. Coupling end 22 is shown as a female element, but may also be configured as a male element in alternate embodiments of the invention. The forward end of bullet-end component 18 has a shoulder 24 forming chamber neck 26.

The middle body component 28 is connected to a substantially cylindrical coupling element 30 of the substantially cylindrical insert 32. Coupling element 30, as shown may be configured as a male element, however, all combinations of male and female configurations is acceptable for coupling elements 30 and coupling end 22 in alternate embodiments of the invention. Coupling end 22 of bullet-end component 18 fits about and engages coupling element 30 of a substantially cylindrical insert 32. The substantially cylindrical insert 32 includes a substantially cylindrical coupling element 30 extending from a bottom surface 34 that is opposite a top surface 36. Located in the top surface 36 is a primer recess 38 that extends toward the bottom surface 34. A primer flash hole 40 is located in the primer flash hole 40 and extends through the bottom surface 34 into the powder chamber 14. The coupling end 22 extends the polymer through the primer flash hole 40 to form an aperture coating 42 while retaining a passage from the top surface 36 through the bottom surface 34 and into the powder chamber 14 to provides support and protection about the primer flash hole 40. When contacted the coupling end 22 interlocks with the substantially cylindrical coupling element 30, through the coupling element 30 that extends with a taper to a smaller diameter at the tip 44 to form a physical interlock between substantially cylindrical insert 32 and middle body component 28. Polymer casing 12 also has a substantially cylindrical open-ended middle body component 28. The middle body component extends from a forward end opening 16 to coupling element 22. Located in the top surface 36 is a primer recess 38 that extends toward the bottom surface 34 with a diffuser 50 positioned in the primer recess 38. The diffuser 50 includes a diffuser aperture 52 that aligns with the primer flash hole 40. The diffuser 50 is a device that is used to divert the affects of the primer (not shown) off of the polymer. The affects being the impact from igniting the primer as far as pressure and heat to divert the energy of the primer off of the polymer and directing it to the flash hole.

Figure 4:
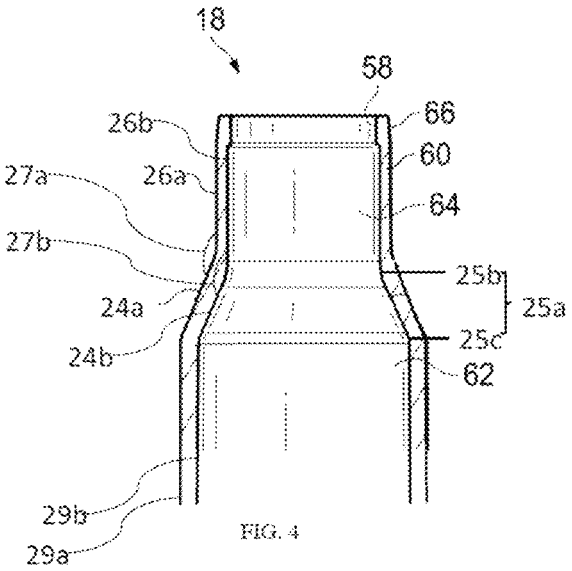
FIGS. 4-10 depict a partial view of a 2 piece polymer case having a nose and a mid-case connected at a joint.

FIG. 4 depicts a partial view of a 2 piece polymer case having a nose and a mid-case connected at a joint. The substantially cylindrical open-ended polymeric bullet-end 18 having a shoulder 24*a* forming chamber neck 26*a* and a bullet (not shown). One embodiment includes modifications to strengthen the neck of the mouth 58 and to the internal area 62 to reduce nose tearing and lodging in the chamber. The substantially cylindrical open-ended polymeric bullet-end 18 can include a lock (e.g., 0.030×0.003) and added a step to allow for the lock to flex out during firing. Polymer was added to the external area to strengthen the neck of the mouth 58 and to the internal area 62. The interference of the bullet to the neck 26*a* was increased by adding polymer to the inside of the neck 26*a* and the exit lock modified by adding an angle to the rim 66. The substantially cylindrical open-ended polymeric bullet-end 18 includes an external shoulder 24*a* and an external neck 26*a* that are a fixed dimension as requires by the chamber (not shown) in which they fit. As a result, the shoulder length extending from the external neck 26*a* to the external side wall 29*a* is of a fixed length. Similarly, the external shoulder plane angle 27*a* to the external neck 26*a* or alternatively to the external side wall 29*a* is fixed relative to the chamber. Similarly, the substantially cylindrical open-ended polymeric bullet-end 18 includes an internal shoulder 24*b* and an internal neck 26*b* that are not fixed dimension and may be varied as desired. As a result, the internal shoulder length 25*a* is determined by the distance from the internal shoulder top 25*b* that extends from the internal neck 26*b* to internal shoulder bottom 25*c* that extends from the internal side wall 29*b*. This internal shoulder length 25*a* may be varied as necessary to achieve the desired properties (e.g., pressure, velocity, temperature, etc.). The internal shoulder plane angle 27*b* is defined as the angle between the internal shoulder 24*b*, and the internal neck 26*b* or the angle between the internal shoulder 24*b* and the internal side wall 29*b*.

The external shoulder 24*a*, the external neck 26*a*, and the external shoulder plane angle 27*a* have fixed values to mate them to the chamber. The relationship between the external shoulder 24*a*, an external neck 26*a*, and external shoulder plane angle 27*a* are caliber ammunition and weapons platform specific and have values. In contrast, the internal shoulder 24*b*, the internal neck 26*b*, and the internal shoulder plane angle 27*b* have no such constraints and can be varied to form the desired internal shoulder profile.

For example, when the internal shoulder plane angle 27*b* is the same as the external shoulder plane angle 27*a* the external shoulder 24*a* and internal shoulder 24*b* are parallel. When the internal shoulder plane angle 27*b* is the same as the external shoulder plane angle 27*a*, the external shoulder 24*a* and internal shoulder 24*b* are parallel. When the internal shoulder plane angle 27*b* is the larger than the external shoulder plane angle 27*a*, internal shoulder 24*b* is longer than the external shoulder 24*a* such that the internal shoulder 24*b* transitions to the internal side wall 29*b* at a distance further away from the external shoulder 24*a*. Thus making a larger distance from the internal shoulder 24*b* to the external shoulder 24*a* as you move toward the shoulder bottom 25*c*. Conversely, when the internal shoulder plane angle 27*b* is the smaller than the external shoulder plane angle 27*a*, there is a larger distance from the internal shoulder 24*b* to the external shoulder 24*a* as you move up the shoulder toward internal shoulder 24*b*. As a result, the internal shoulder length 25*a* is determined by the distance from the internal shoulder top 25*b* that extends from the internal neck 26*b* to internal shoulder bottom 25*c* that extends from the internal side wall 29*b*. This internal shoulder length 25*a* may be varied as necessary to achieve the desired properties (e.g., pressure, velocity, temperature, etc.). The internal shoulder plane angle 27*b* is defined as the angle between the internal shoulder 24*b*, and the internal neck 26*b* or the angle between the internal shoulder 24*b* and the internal side wall 29*b*.

Figure 5:
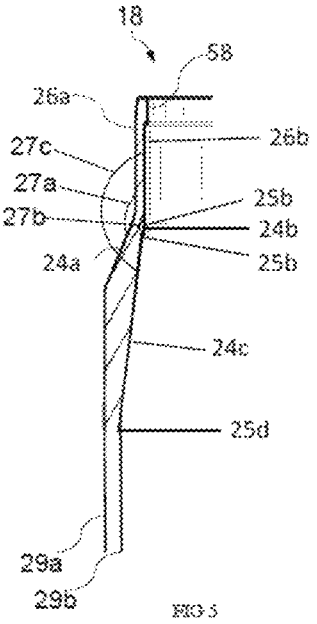
Figure 6:
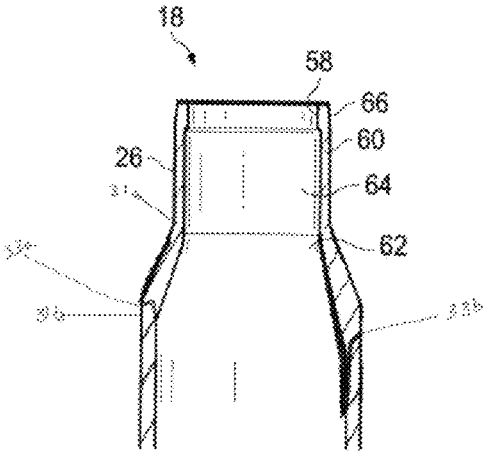
Figure 7:
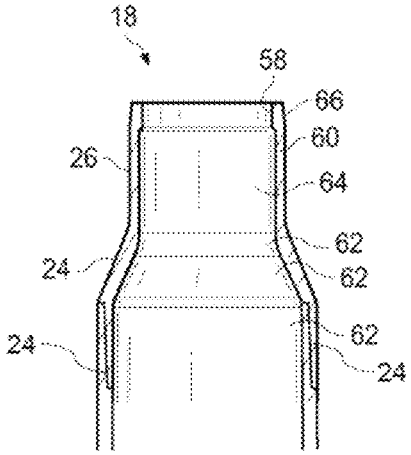
Figure 8:
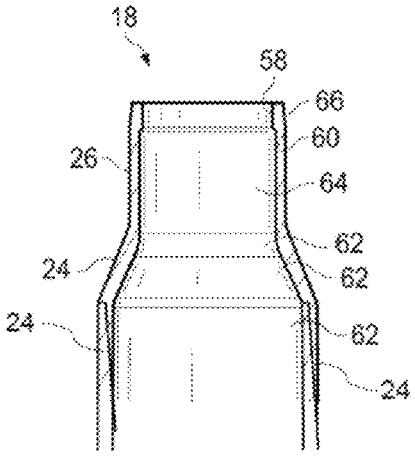
Figure 9:
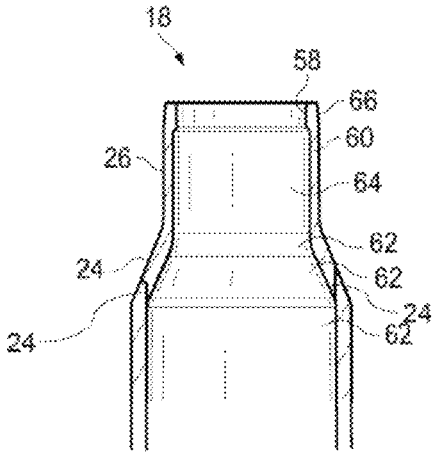
Figure 10:
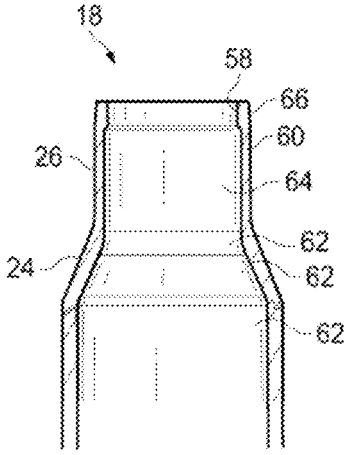

FIG. 5 depicts a partial view of a 2 piece polymer case having a nose and a mid-case connected at a joint. FIG. 5 depicts a partial view of the substantially cylindrical open-ended polymeric bullet-end 18 having a shoulder 24*a* forming chamber neck 26*a* and a bullet aperture 58. The interference of the bullet (not shown) to the neck 26*a* can be increased by adding polymer to the inside of the neck 26*a* or making the neck from a more ridged polymer. The substantially cylindrical open-ended polymeric bullet-end 18 includes an external shoulder 24*a* and an external neck 26*a* that are of fixed dimension as requires by the chamber (not shown) in which they fit. As a result, the shoulder length extends from the external neck 26*a* to the external side wall 29*a* as a fixed length. Similarly, the external shoulder plane angle 27*a* relative to the external neck 26*a* (or alternatively to the external side wall 29*a*) is a fixed angle relative to the chamber. Similarly, the substantially cylindrical open-ended polymeric bullet-end 18 includes an internal shoulder 24*b* and an internal neck 26*b* that are not of fixed dimension but may be varied as desired. In some embodiments, the internal shoulder 24*b* may be connected to one or more transition segments 24*c* to form a transition from the internal shoulder 24*b* to the internal neck 26*b* or the internal side wall 29*b*. The one or more transition segments 24*c* may be straight, curved or a mix thereof. For example, the internal shoulder 24*b* is connected to one or more transition segments 24*c* (although 2, 3, 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, 50, 51, 52, 53, 54, 55, 56, 57, 58, 59, 60, 61, 62, 63, 64, 65, 66, 67, 68, 69, 70, 71, 72, 73, 74, 75, 76, 77, 78, 79, 80, 81, 82, 83, 84, 85, 86, 87, 88, 89, 90, 91, 92, 93, 94, 95, 96, 97, 98, 99, 100 or more segments can be used). The internal shoulder 24*b* extends from the internal shoulder top 25*b* to the internal shoulder bottom 25*c*. The internal shoulder 24*b* has a shoulder plane angle 27*b* that is the same as the external shoulder plane angle 27*a*. Therefore the internal shoulder 24*b* is parallel to the shoulder 24*a* over the internal shoulder length. The one or more transition segments 24*c* have a transition plane angle 27*c* that is larger than the external shoulder plane angle 27*a* and the internal shoulder plane angle 27*b*. The one or more transition segments 24*c* extend from the internal shoulder bottom 25*c* to the transition bottom 25*d*; however, the transition plane angle 27*c* is not the same as the external shoulder plane angle 27*a* or the internal shoulder plane angle 27*b*. Although this example depicts an internal shoulder 24*b* and one or more transition segments 24*c*, 3, 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, 50, 51, 52, 53, 54, 55, 56, 57, 58, 59, 60, 61, 62, 63, 64, 65, 66, 67, 68, 69, 70, 71, 72, 73, 74, 75, 76, 77, 78, 79, 80, 81, 82, 83, 84, 85, 86, 87, 88, 89, 90, 91, 92, 93, 94, 95, 96, 97, 98, 99, 100, or more internal shoulders and/or transition segments 24*c* can be used.

Therefore the internal shoulder 24*b* is parallel to the external shoulder 24*a* over the internal shoulder length. The skilled artisan will readily understand that the transition plane angle 27*c* can be adjusted to move the transition bottom 25*d* up and down the interior side wall 29*b*. Similarly the number of transition segments 24*c* can be varied to adjust to move the transition bottom 25*d* up and down the interior side wall 29*b*. In addition, the transition segments 24*c* may be a plethora of short segments connected together to from an arc or radii. The number of transition segments 24*c* may be such that an almost smooth arc is formed or so few that an angular profile is formed. Similarly, the angle of each transition segments 24*c* relative to the adjacent transition segments may be similar or different as necessary.

The external shoulder 24*a*, the external neck 26*a*, and the external shoulder plane angle 27*a* have fixed values to mate them to the chamber. The relationship between the external shoulder 24*a*, an external neck 26*a*, and external shoulder plane angle 27*a* are caliber ammunition and weapons platform specific and have values. In contrast, the internal shoulder 24*b*, the internal neck 26*b*, and the internal shoulder plane angle 27*b* have no such constraints and can be varied to form the desired internal shoulder profile.

For example, when the internal shoulder plane angle 27*b* is the same as the external shoulder plane angle 27*a* the external shoulder 24*a* and internal shoulder 24*b* are parallel. When the internal shoulder plane angle 27*b* is the same as the external shoulder plane angle 27*a*, the external shoulder 24*a* and internal shoulder 24*b* are parallel. When the internal shoulder plane angle 27*b* is the larger than the external shoulder plane angle 27*a*, internal shoulder 24*b* is longer than the external shoulder 24*a* such that the internal shoulder 24*b* transitions to the internal side wall 29*b* at a distance further away from the external shoulder 24*a*. Thus making a larger distance from the internal shoulder 24*b* to the external shoulder 24*a* as you move toward the shoulder bottom 25*c*. Conversely, when the internal shoulder plane angle 27*b* is the smaller than the external shoulder plane angle 27*a*, there is a larger distance from the internal shoulder 24*b* to the external shoulder 24*a* as you move up the shoulder toward internal shoulder 24*b*.

FIGS. 6-10 depict a partial view of a 2 piece polymer case having a nose and a mid-case connected at a joint. The joint may be located in the middle body component 28 or in the middle body-shoulder transition region 31*a* to 31*b*. Specifically, the joint 33*a* and 33*b* may be located anywhere within the middle body-shoulder transition region 31*a* to 31*b*. The mid-case-shoulder transition region 31*a* covers the neck 26 to shoulder transition area and extends to the shoulder-mid-case transition region. The mid-case-shoulder transition region 31*b* is located on the upper portion of the middle body component 28. The joint 31 may be of any configuration that allows the connection of the nose 18 and the middle body component 28. For example, the joint may be a butt joint, a bevel lap splice joint, a half lap joint, a lap joint, a square joint, a single bevel joint, double bevel joint, single J joint, double J joint, single v joint, double v joint, single U joint, double U joint, flange joint, tee joint, flare joint, edge joint, rabbit joint, dado and any other joint. In addition, the joint type may be modified to allow a gap at regions in the joint. For example, a dado joint may be formed where the fit is not square allowing gaps to form at the corner of the dado. Similarly, a compound joint may be used, e.g., rabbit joint transitioning to a butt joint transitioning to a bevel joint (modified to have a gap in the fit) transitioning to a butt joint and ending in a lap joint or rabbit joint. In addition the angle of the joint need not be at 90 and 180 degrees. The joint angle may be at any angle from 0-180 degrees and may vary along the joint. For instance the joint may start at a 0 degree move to a +45 degree angle transition to a −40 degree angle and conclude by tapering at a 10 degree angle. The variation in the joint type, position, and internal shoulder length, internal shoulder angle, transition region angle, transition region length and other parameters are shown in FIGS. 6-10.

In another embodiment of the present invention the ammunition, ammunition cartridge, and components may chamber a standard projectile (e.g., 0.45 mm, 5.56 mm, 6.5 mm, 6.8 mm, 7 mm, 7.62 mm, 8 mm, 9 mm, 10 mm, 12.7 mm, 14.5 mm, 20 mm, 25 mm, 30 mm, 40 mm, .22, .22-250, .223, .243, .25-06, .270, .277, .300, .30-30, .30-40, 3.06, .300, .303, .308, .338, .357, .38, .380, .40, .44, .45, .45-70, .50 caliber) or a nonstandard projectile in a non-traditional cartridge. The nontraditional cartridge may be a result of the neck diameter, neck length, neck thickness, shoulder angle, shoulder length, shoulder angle, shoulder thickness may be varied to form a unique ammunition, ammunition cartridge, and components.

Figure 11:
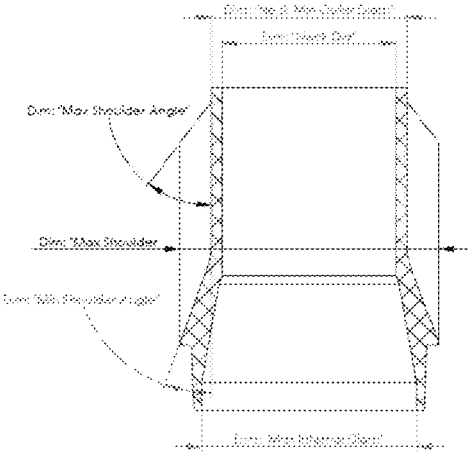
FIG. 11 depict a side, cross-sectional view case of the various dimensions of embodiments of the noses.
Figure 12A:
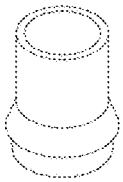
FIGS. 12A-41B depict a side, cross-sectional view case of the various noses that can be substituted for the generic nose in FIG. 1 to form a polymeric cartridge case.
Figure 12B:
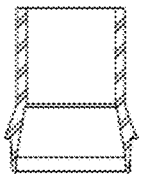
Figure 13A:
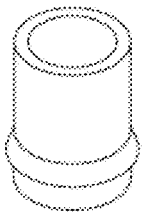
Figure 13B:
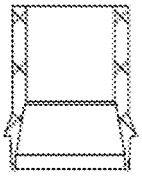
Figure 14A:
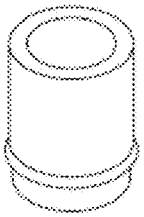
Figure 14B:
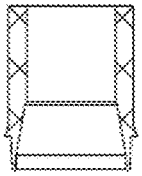
Figure 15A:
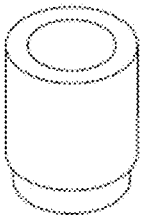
Figure 15B:
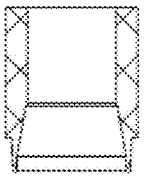
Figure 16A:
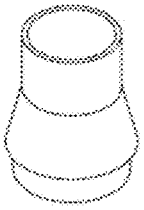
Figure 16B:
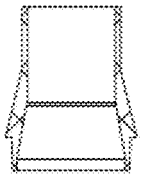
Figure 17A:
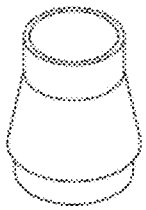
Figure 17B:
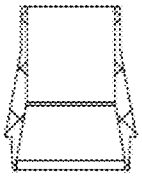
Figure 18A:
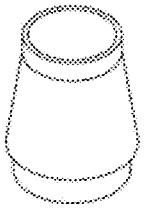
Figure 18B:
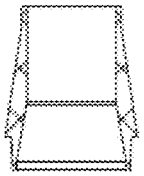
Figure 19A:
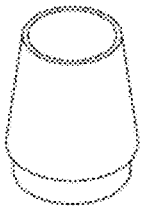
Figure 19B:
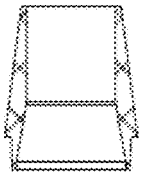
Figure 20A:
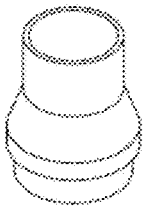
Figure 20B:
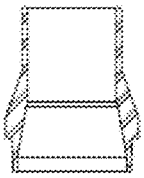
Figure 21A:
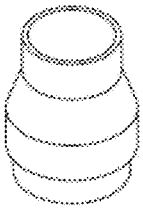
Figure 21B:
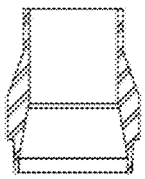
Figure 22A:
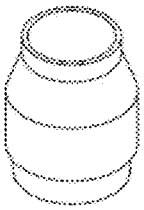
Figure 22B:
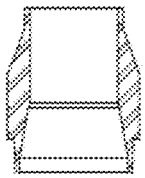
Figure 23A:
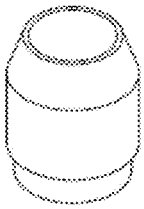
Figure 23B:
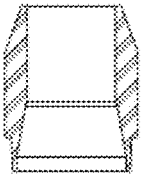
Figure 24A:
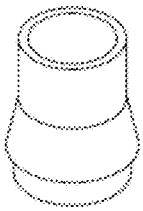
Figure 24B:
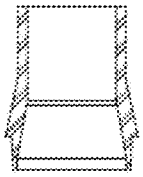
Figure 25A:
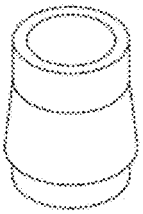
Figure 25B:
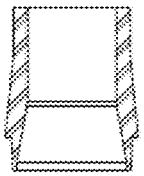
Figure 26A:
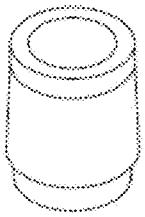
Figure 26B:
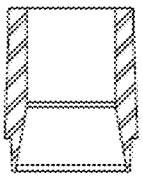
Figure 27A:
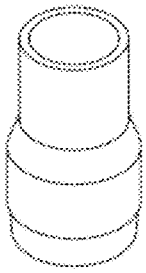
Figure 27B:
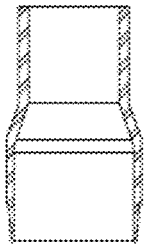
Figure 28A:
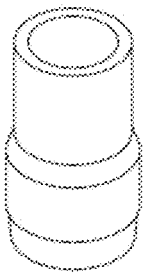
Figure 28B:
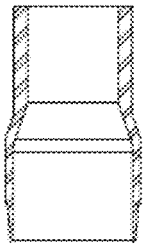
Figure 29A:
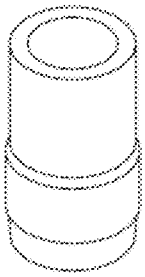
Figure 29B:
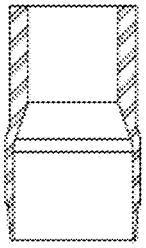
Figure 30A:
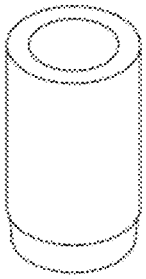
Figure 30B:
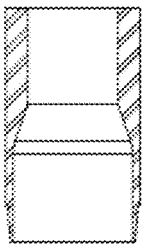
Figure 31A:
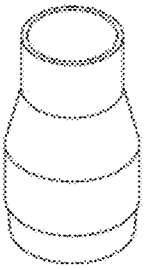
Figure 31B:
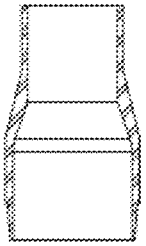
Figure 32A:
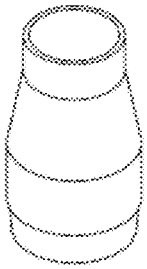
Figure 32B:
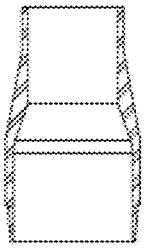
Figure 33A:
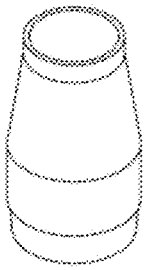
Figure 33B:
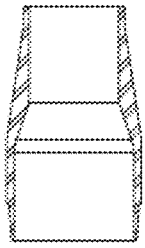
Figure 34A:
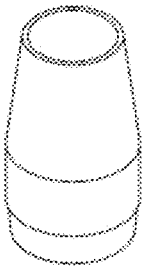
Figure 34B:
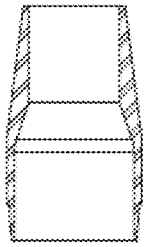
Figure 35A:
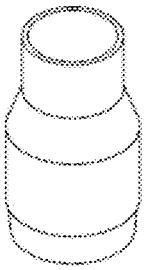
Figure 35B:
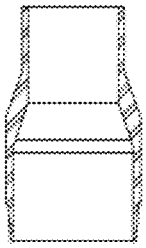
Figure 36A:
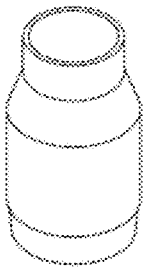
Figure 36B:
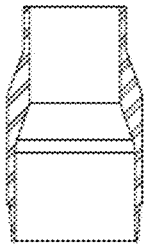
Figure 37A:
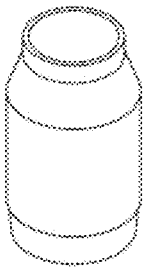
Figure 37B:
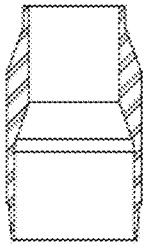
Figure 38A:
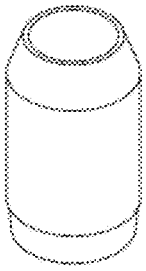
Figure 38B:
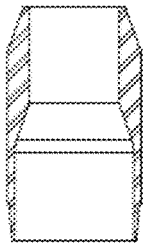
Figure 39A:
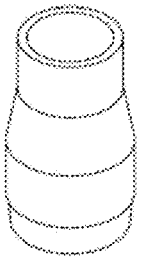
Figure 39B:
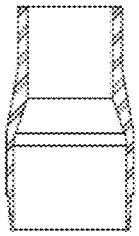
Figure 40A:
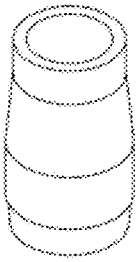
Figure 40B:
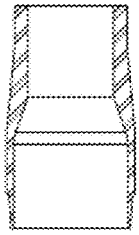
Figure 41A:
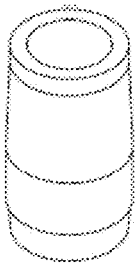
Figure 41B:
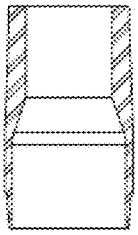

FIG. 11 illustrates a generic embodiment of the nose to define the various angles of the nose because the caliber of the ammunition dictates the size and shape of the nose shoulder angle and shoulder length as well as the neck length. The dimensions are listed in the table below as the midpoint and are intended to include a range of +10% for a given embodiment.

| Caliber | Neck Diameter | Neck Min Outer Diameter | Max Shoulder Diameter | Min Internal Diameter | Max Outer Shoulder Angle | Min Outer Shoulder Angle |
|---|---|---|---|---|---|---|
| 7.62 | 0.344 | 0.306 | 0.454 | 0.35 | 50 | 20 |
| 5.56 | 0.222 | 0.25 | 0.354 | 0.25 | 55 | 23 |
| 12.7 × 99 | 0.509 | 0.556 | 0.715 | 0.6 | 50 | 15 |
| 12.7 × 108 | 0.509 | 0.548 | 0.746 | 0.65 | 50 | 18 |
| 0.338 | 0.336 | 0.366 | 0.577 | 0.455 | 50 | 50.2 |
| 0.277 | 0.275 | 0.304 | 0.462 | 0.39 | 50 | 20 |

The polymeric ammunition cartridges of the present invention are of a caliber typically carried by soldiers in combat for use in their combat weapons. The present invention is not limited to the described caliber and is believed to be applicable to other calibers as well. This includes various small and medium caliber munitions, including 5.45 mm, 5.56 mm, 6.5 mm, 6.8 mm, 7 mm, 7.62 mm, 8 mm, 9 mm, 10 mm, 12.7 mm, 14.5 mm, 20 mm, 25 mm, 30 mm, 40 mm, .22, .22-250, .223, .243, .25-06, .270, .277, .300, .30-30, .30-40, 3.06, .300, .303, .308, .338, .357, .38, .380, .40, .44, .45, .45-70, .50 BMG caliber ammunition, cases, cartridges and components of ammunition, cases, cartridges. The ammunition and ammunition cartridge as well as the nose and base used to assemble the ammunition and the cartridge has a standardized size, shape and dimensions based on the caliber and chamber of the gun in which it is chambered. The chamber and the ammunition mate such that they have the same characteristics. The specific neck, shoulder, case diameter projectile aperture, and case length are known to the skilled and those standard measurements are available and known. In other embodiments of the instant application, the ammunition and ammunition cartridge as well as the nose and base used to assemble the ammunition and the cartridge have a nonstandardized size, shape and dimensions as described and illustrated herein.

Figure 42A:
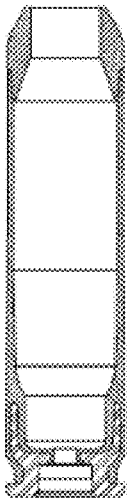
Figure 42B:
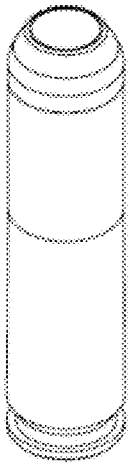
FIG. 42B depicts a side, elevation view of a nontraditional ammunition cartridge.
Figure 42C:
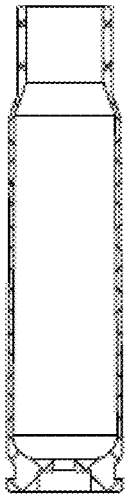
Figure 42D:
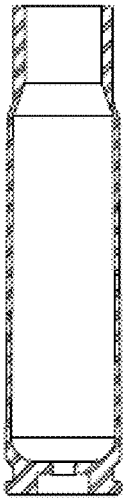
Figure 43E:
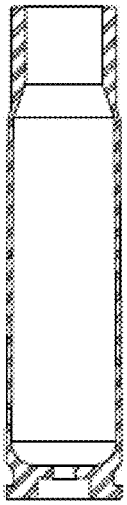

To illustrate some embodiments of the nontraditional cases various nose configurations are shown in FIGS. 12A-41B. For example, as seen in FIG. 1 the nose is connected to the mid-body to form an ammunition cartridge. The noses shown in any of FIGS. 12A-41B may be connected to the mid-body as in FIG. 1 to form nontraditional cases and ammunition. FIGS. 42A, 42C, 42D and 42E depict a side, cross-sectional view of a nontraditional ammunition cartridges, while FIG. 42B depicts a side, elevation view of a nontraditional ammunition cartridge. Although, the figures depict only a few nose midbody combinations the disclosure clearly envisions numerous combination of midbody and nose, e.g., FIGS. 12A-41B.

FIGS. 12A-41B illustrate some of the nontraditional nose configurations where the neck length (defined as the distance from the shoulder to the projectile aperture) is varied and may be 0%, 1%, 2%, 3%, 4%, 5%, 6%, 7%, 8%, 9%, 10%, 11%, 12%, 13%, 14%, 15%, 16%, 17%, 18%, 19%, 20%, 21%, 22%, 23%, 24%, 25%, 26%, 27%, 28%, 29%, 30%, 31%, 32%, 33%, 34%, 35%, 36%, 37%, 38%, 39%, 40%, 41%, 42%, 43%, 44%, 45%, 46%, 47%, 48%, 49%, 50%, 51%, 52%, 53%, 54%, 55%, 56%, 57%, 58%, 59%, 60%, 61%, 62%, 63%, 64%, 65%, 66%, 67%, 68%, 69%, 70%, 71%, 72%, 73%, 74%, 75%, 76%, 77%, 78%, 79%, 80%, 81%, 82%, 83%, 84%, 85%, 86%, 87%, 88%, 89%, 90%, 91%, 92%, 93%, 94%, 95%, 96%, 97%, 98%, 99%, or 100% less than the neck length of a standard comparable cartridge of the same caliber. This is seen in FIGS. 44A and 44B where the neck is 100% less than the neck length of a standard comparable cartridge of the same caliber to render the neck length zero.

FIGS. 12A-41B illustrate some of the nontraditional nose configurations where the shoulder angle is varied and may be any angle between 35, 36, 37, 38, 39, 40, 41, 42, 43, 44, 45, 46, 47, 48, 49, 50, 51, 52, 53, 54, 55, 56, 57, 58, 59, 60, 61, 62, 63, 64, 65, 66, 67, 68, 69, 70, 71, 72, 73, 74, 75, 76, 77, 78, 79, 80, 81, 82, 83, 84, 85, 86, 87, 88, 89, 90 degrees and incremental variations (e.g., 0.1, 0.2, 0.3, 0.4, 0.5, 0.6, 0.7, 0.8, or 0.9) thereof.

FIGS. 12A-41B illustrate some of the nontraditional nose configurations where the shoulder length is varied and may be any length, e.g., +0%, 1%, 2%, 3%, 4%, 5%, 6%, 7%, 8%, 9%, 10%, 11%, 12%, 13%, 14%, 15%, 16%, 17%, 18%, 19%, 20%, 21%, 22%, 23%, 24%, 25%, 26%, 27%, 28%, 29%, 30%, 31%, 32%, 33%, 34%, 35%, 36%, 37%, 38%, 39%, 40%, 41%, 42%, 43%, 44%, 45%, 46%, 47%, 48%, 49%, 50%, 51%, 52%, 53%, 54%, 55%, 56%, 57%, 58%, 59%, 60%, 61%, 62%, 63%, 64%, 65%, 66%, 67%, 68%, 69%, 70%, 71%, 72%, 73%, 74%, 75%, 76%, 77%, 78%, 79%, 80%, 81%, 82%, 83%, 84%, 85%, 86%, 87%, 88%, 89%, 90%, 91%, 92%, 93%, 94%, 95%, 96%, 97%, 98%, 99%, or 100% more or less than the shoulder length of a standard comparable cartridge of the same caliber. This variation is easily seen in FIGS. 30A, 31A, 32A, 33A, 34A, etc.

FIGS. 12A-41B illustrate some of the nontraditional nose configurations where the neck diameter is increased by 1%, 2%, 3%, 4%, 5%, 6%, 7%, 8%, 9%, 10%, 11%, 12%, 13%, 14%, 15%, 16%, 17%, 18%, 19%, 20%, 21%, 22%, 23%, 24%, 25%, 26%, 27%, 28%, 29%, 30%, 31%, 32%, 33%, 34%, 35%, 36%, 37%, 38%, 39%, 40%, 41%, 42%, 43%, 44%, 45%, 46%, 47%, 48%, 49%, 50%, 51%, 52%, 53%, 54%, 55%, 56%, 57%, 58%, 59%, 60%, 61%, 62%, 63%, 64%, 65%, 66%, 67%, 68%, 69%, 70%, 71%, 72%, 73%, 74%, 75%, 76%, 77%, 78%, 79%, 80%, 81%, 82%, 83%, 84%, 85%, 86%, 87%, 88%, 89%, 90%, 91%, 92%, 93%, 94%, 95%, 96%, 97%, 98%, 99%, or 100% more or less than the shoulder length of a standard comparable cartridge of the same caliber, e.g., FIGS. 24A, 25A, 26A, 29A, 30A, 40A, 41A).

These configurations can be used to effectively form a nose with no shoulder (e.g., 30A), shoulder with no nose (38A) and every variation in-between. When the nontraditional ammunition of the present invention is made the corresponding platform chamber must have the mating profile of the ammunition to allow the fitting of the ammunition, firing and ejecting of the ammunition. The present invention includes automatic and semiautomatic rifles having a chamber that mates and fits the nontraditional ammunition of the instant invention.

In addition, the interior neck, exterior neck, external shoulder and the nose junction may individually be textured in the form of one or more selected from etching, grooves, hatching, knurling, a texture, rings, and free formed textures.

The chamber neck 26 and the internal neck 26*b* are shown as generally parallel to each other; however, the chamber neck 26 and the internal neck 26*b* may be tapered such that at the mouth 58 the distance from the chamber neck 26 to the internal neck 26*b* is less than the distance from the chamber neck 26 to the internal neck 26*b* at the shoulder 24. In addition, the mouth 58 may include a groove (not shown) that extends around the internal neck 26*b*. The internal neck 26*b* may include a texturing; however, distance from the internal neck 26*b* to the chamber neck 26 may be accessed using the average distance from the top texture surface (not shown) to the bottom texture surface (not shown) of the texturing, the top texture surface (not shown) of the texturing or the bottom texture surface (not shown) of the texturing.

The insert may be made by any method including MIM, cold forming, milling, machining, printing, 3D printing, etching and so forth.

The polymeric and composite casing components may be injection molded including overmolding into the flash aperture. Polymeric materials for the bullet-end and middle body components must have propellant compatibility and resistance to gun cleaning solvents and grease, as well as resistance to chemical, biological and radiological agents. The polymeric materials must have a temperature resistance higher than the cook-off temperature of the propellant, typically about 320° F. The polymeric materials must have elongation-to-break values that to resist deformation under interior ballistic pressure as high as 60,000 psi in all environments (temperatures from about −65 to about 320° F. and humidity from 0 to 100% RH). According to one embodiment, the middle body component is either molded onto or snap-fit to the casing head-end component after which the bullet-end component is snap-fit or interference fit to the middle body component. The components may be formed from high-strength polymer, composite or ceramic.

Examples of suitable high strength polymers include composite polymer material including a tungsten metal powder, nylon 6/6, nylon 6, and glass fibers; and a specific gravity in a range of 3-10. The tungsten metal powder may be 50%-96% of a weight of the bullet body. The polymer material also includes about 0.5-15%, preferably about 1-12%, and most preferably about 2-9% by weight, of nylon 6/6, about 0.5-15%, preferably about 1-12%, and most preferably about 2-9% by weight, of nylon 6, and about 0.5-15%, preferably about 1-12%, and most preferably about 2-9% by weight, of glass fibers. It is most suitable that each of these ingredients be included in amounts less than 10% by weight. The cartridge casing body may be made of a modified ZYTEL resin, available from E.I. DuPont De Nemours Co., a modified 612 nylon resin, modified to increase elastic response.

Examples of suitable polymers include polyurethane prepolymer, cellulose, fluoro-polymer, ethylene inter-polymer alloy elastomer, ethylene vinyl acetate, nylon, polyether imide, polyester elastomer, polyester sulfone, polyphenyl amide, polypropylene, polyvinylidene fluoride or thermoset polyurea elastomer, acrylics, homopolymers, acetates, copolymers, acrylonitrile-butadinen-styrene, thermoplastic fluoro polymers, inomers, polyamides, polyamide-imides, polyacrylates, polyatherketones, polyaryl-sulfones, polybenzimidazoles, polycarbonates, polybutylene, terephthalates, polyether imides, polyether sulfones, thermoplastic polyimides, thermoplastic polyurethanes, polyphenylene sulfides, polyethylene, polypropylene, polysulfones, polyvinylchlorides, styrene acrylonitriles, polystyrenes, polyphenylene, ether blends, styrene maleic anhydrides, polycarbonates, allyls, aminos, cyanates, epoxies, phenolics, unsaturated polyesters, bismaleimides, polyurethanes, silicones, vinylesters, or urethane hybrids. Examples of suitable polymers also include aliphatic or aromatic polyamide, polyeitherimide, polysulfone, polyphenylsulfone, poly-phenylene oxide, liquid crystalline polymer and polyketone. Examples of suitable composites include polymers such as polyphenylsulfone reinforced with between about 30 and about 70 wt %, and preferably up to about 65 wt % of one or more reinforcing materials selected from glass fiber, ceramic fiber, carbon fiber, mineral fillers, organo nanoclay, or carbon nanotube. Preferred reinforcing materials, such as chopped surface-treated E-glass fibers provide flow characteristics at the above-described loadings comparable to unfilled polymers to provide a desirable combination of strength and flow characteristics that permit the molding of head-end components. Composite components can be formed by machining or injection molding. Finally, the cartridge case must retain sufficient joint strength at cook-off temperatures. More specifically, polymers suitable for molding of the projectile-end component have one or more of the following properties: Yield or tensile strength at −65° F.>10,000 psi Elongation-to-break at −65° F.>15% Yield or tensile strength at 73° F.>8,000 psi Elongation-to-break at 73° F.>50% Yield or tensile strength at 320° F.>4,000 psi Elongation-to-break at 320° F.>80%. Polymers suitable for molding of the middle-body component have one or more of the following properties: Yield or tensile strength at −65° F.>10,000 psi Yield or tensile strength at 73° F.>8,000 psi Yield or tensile strength at 320° F.>4,000 psi.

Commercially available polymers suitable for use in the present invention thus include polyphenylsulfones; copolymers of polyphenylsulfones with polyether-sulfones or polysulfones; copolymers and blends of polyphenylsulfones with polysiloxanes; poly(etherimide-siloxane); copolymers and blends of polyetherimides and polysiloxanes, and blends of polyetherimides and poly(etherimide-siloxane) copolymers; and the like. Particularly preferred are polyphenylsulfones and their copolymers with poly-sulfones or polysiloxane that have high tensile strength and elongation-to-break to sustain the deformation under high interior ballistic pressure. Such polymers are commercially available, for example, RADEL R5800 polyphenylesulfone from Solvay Advanced Polymers. The polymer can be formulated with up to about 10 wt % of one or more additives selected from internal mold release agents, heat stabilizers, anti-static agents, colorants, impact modifiers and UV stabilizers.

The polymers of the present invention can also be used for conventional two-piece metal-plastic hybrid cartridge case designs and conventional shotgun shell designs. One example of such a design is an ammunition cartridge with a one-piece substantially cylindrical polymeric cartridge casing body with an open projectile-end and an end opposing the projectile-end with a male or female coupling element; and a cylindrical metal cartridge casing head-end component with an essentially closed base end with a primer hole opposite an open end having a coupling element that is a mate for the coupling element on the opposing end of the polymeric cartridge casing body joining the open end of the head-end component to the opposing end of the polymeric cartridge casing body. The high polymer ductility permits the casing to resist breakage.

One embodiment includes a 2 cavity prototype mold having an upper portion and a base portion for a 5.56 case having a metal insert over-molded with a Nylon 6 (polymer) based material. In this embodiment the polymer in the base includes a lip or flange to extract the case from the weapon. One 2-cavity prototype mold to produce the upper portion of the 5.56 case can be made using a stripper plate tool using an Osco hot spur and two subgates per cavity. Another embodiment includes a subsonic version, the difference from the standard and the subsonic version is the walls are thicker thus requiring less powder. This will decrease the velocity of the bullet thus creating a subsonic round.

The extracting inserts is used to give the polymer case a tough enough ridge and groove for the weapons extractor to grab and pull the case out the chamber of the gun. The extracting insert is made of 17-4 ss that is hardened to 42-45rc. The insert may be made of aluminum, brass, cooper, steel or even an engineered resin with enough tensile strength.

The insert is over molded in an injection molded process using a nano clay particle filled Nylon material. The inserts can be machined or stamped. In addition, an engineered resin able to withstand the demand on the insert allows injection molded and/or even transfer molded.

One of ordinary skill in the art will know that many propellant types and weights can be used to prepare workable ammunition and that such loads may be determined by a careful trial including initial low quantity loading of a given propellant and the well known stepwise increasing of a given propellant loading until a maximum acceptable load is achieved. Extreme care and caution is advised in evaluating new loads. The propellants available have various burn rates and must be carefully chosen so that a safe load is devised.

The description of the preferred embodiments should be taken as illustrating, rather than as limiting, the present invention as defined by the claims. As will be readily appreciated, numerous combinations of the features set forth above can be utilized without departing from the present invention as set forth in the claims. Such variations are not regarded as a departure from the spirit and scope of the invention, and all such modifications are intended to be included within the scope of the following claims.

It will be understood that particular embodiments described herein are shown by way of illustration and not as limitations of the invention. The principal features of this invention can be employed in various embodiments without departing from the scope of the invention. Those skilled in the art will recognize, or be able to ascertain using no more than routine experimentation, numerous equivalents to the specific procedures described herein. Such equivalents are considered to be within the scope of this invention and are covered by the claims.

The use of the word "a" or "an" when used in conjunction with the term "comprising" in the claims and/or the specification may mean "one," but it is also consistent with the meaning of "one or more," "at least one," and "one or more than one." The use of the term "or" in the claims is used to mean "and/or" unless explicitly indicated to refer to alternatives only or the alternatives are mutually exclusive, although the disclosure supports a definition that refers to only alternatives and "and/or." Throughout this application, the term "about" is used to indicate that a value includes the inherent variation of error for the device, the method being employed to determine the value, or the variation that exists among the study subjects. As used in this specification and claim(s), the words "comprising" (and any form of comprising, such as "comprise" and "comprises"), "having" (and any form of having, such as "have" and "has"), "including" (and any form of including, such as "includes" and "include") or "containing" (and any form of containing, such as "contains" and "contain") are inclusive or open-ended and do not exclude additional, unrecited elements or method steps.

The term "or combinations thereof" as used herein refers to all permutations and combinations of the listed items preceding the term. For example, "A, B, C, or combinations thereof" is intended to include at least one of: A, B, C, AB, AC, BC, or ABC, and if order is important in a particular context, also BA, CA, CB, CBA, BCA, ACB, BAC, or CAB. Continuing with this example, expressly included are combinations that contain repeats of one or more item or term, such as BB, AAA, AB, BBC, AAABCCCC, CBBAAA, CABABB, and so forth. The skilled artisan will understand that typically there is no limit on the number of items or terms in any combination, unless otherwise apparent from the context.

What is claimed is:

1. A nose for an ammunition cartridge comprising:

a generally cylindrical neck having a projectile aperture at a first end;

a shoulder comprising a shoulder top that extends to a shoulder bottom;

wherein the projectile aperture is continuous with the shoulder top;

a nose junction positioned around the shoulder bottom, wherein the nose junction comprises a half lap junction having a groove adjacent to a skirt adapted to mate to a base junction in an ammunition cartridge, wherein the skirt is positioned on the inside of the nose and extends away from the shoulder bottom.

2. A multi piece ammunition cartridge comprising:

an primer insert comprising a top surface opposite a bottom surface and a substantially cylindrical coupling element that extends from the bottom surface, a primer recess in the top surface that extends toward the bottom surface, a primer flash hole aperture positioned in the primer recess to extend through the bottom surface, and a groove positioned around the primer flash hole aperture in the primer recess;

a middle body comprising a body extending from a body half lap junction to the primer insert, wherein the body is molded at least partially the primer insert by molding over the cylindrical coupling element and into the primer flash hole aperture and into the groove to form a primer flash hole; and a nose connected to the middle body, wherein the nose comprises a generally cylindrical neck having a projectile aperture at a first end; a shoulder comprising a shoulder top that extends to a shoulder bottom; wherein the projectile aperture is continuous with the shoulder top; a nose junction positioned around the shoulder bottom, wherein the nose junction comprises a half lap junction having a groove adjacent to a skirt adapted to mate to the body half lap junction to form an ammunition cartridge, wherein a propellant chamber is formed between the projectile aperture and the primer flash hole.

3. A multi piece ammunition cartridge comprising:

an primer insert comprising a top surface opposite a bottom surface and a substantially cylindrical coupling element that extends from the bottom surface, a primer recess in the top surface that extends toward the bottom surface, a primer flash hole aperture positioned in the primer recess to extend through the bottom surface, and a groove positioned around the primer flash hole aperture in the primer recess;

a middle body comprising a body extending from a body half lap junction to the primer insert, wherein the body is molded at least partially the primer insert by molding over the cylindrical coupling element and into the primer flash hole aperture and into the groove to form a primer flash hole; and a shortened neck having a projectile aperture at a first end, wherein the projectile aperture is continuous with the shoulder top; a shoulder comprising a shoulder top connected to the shortened neck that extends to a shoulder bottom; a nose junction positioned adjacent to the shoulder bottom, wherein the nose junction comprises a half lap junction having a groove adjacent to a skirt adapted to mate to the body half lap junction to form an ammunition cartridge, wherein a propellant chamber is formed between the projectile aperture and the primer flash hole.

4. A nose for an ammunition cartridge comprising:

a neck having a projectile aperture at a first end, wherein the projectile aperture is continuous with the shoulder top;

a shoulder comprising a shoulder top connected to the neck that extends to a shoulder bottom;

a nose junction positioned adjacent to the shoulder bottom, wherein the nose junction comprises a half lap junction having a groove adjacent to a skirt adapted to mate to a base junction in an ammunition cartridge, wherein the skirt is positioned on the inside of the nose and extends away from the shoulder bottom.

5. An ammunition cartridge having a reduced neck height comprising:

a neck having a projectile aperture;

a shoulder extending from the neck to a cartridge side wall wherein the projectile aperture is continuous with the shoulder top; and wherein the cartridge side wall extends from the shoulder to the base to form an interior propellant chamber; wherein the base comprises an extraction ring, a primer recess positioned in the base in communication with the propellant chamber through a flash hole that extends from the primer recess into the propellant chamber.

6. The invention according to claim 1, wherein the nose comprises a polymer, a metal an alloy or a combination thereof.

7. The invention according to claim 5, wherein the nose comprises a polymer, a metal an alloy or a combination thereof and the middle body comprises a polymer, a metal an alloy or a combination thereof.

8. The invention according to claim 1, wherein the polymer comprises comprise one or more polymers selected from the group consisting of polyurethane prepolymer, cellulose, fluoro-polymer, ethylene inter-polymer alloy elastomer, ethylene vinyl acetate, nylon, polyether imide, polyester elastomer, polyester sulfone, polyphenyl amide, polypropylene, polyvinylidene fluoride or thermoset polyurea elastomer, acrylics, homopolymers, acetates, copolymers, acrylonitrile-butadinen-styrene, thermoplastic fluoro polymers, inomers, polyamides, polyamide-imides, polyacrylates, polyatherketones, polyaryl-sulfones, polybenzimidazoles, polycarbonates, polybutylene, Polybutylene terephthalate, terephthalates, polyether imides, polyether sulfones, thermoplastic polyimides, thermoplastic polyurethanes, polyphenylene sulfides, polyethylene, polypropylene, polysulfones, polyvinylchlorides, styrene acrylonitriles, polystyrenes, polyphenylene, ether blends, styrene maleic anhydrides, polycarbonates, allyls, aminos, cyanates, epoxies, phenolics, unsaturated polyesters, bismaleimides, polyurethanes, silicones, vinylesters, urethane hybrids, polyphenylsulfones, copolymers of polyphenylsulfones with polyethersulfones or polysulfones, copolymers of poly-phenylsulfones with siloxanes, blends of polyphenylsulfones with polysiloxanes, poly(etherimide-siloxane) copolymers, blends of polyetherimides and polysiloxanes, and blends of polyetherimides and poly(etherimide-siloxane) copolymers.

9. The invention according to claim 1, wherein the polymer comprises comprise one or more polymers selected from the group consisting of polyurethane prepolymer, cellulose, fluoro-polymer, ethylene inter-polymer alloy elastomer, ethylene vinyl acetate, nylon, polyether imide, polyester elastomer, polyester sulfone, polyphenyl amide, polypropylene, polyvinylidene fluoride or thermoset polyurea elastomer, acrylics, homopolymers, acetates, copolymers, acrylonitrile-butadinen-styrene, thermoplastic fluoro polymers, inomers, polyamides, polyamide-imides, polyacrylates, polyatherketones, polyaryl-sulfones, polybenzimidazoles, polycarbonates, polybutylene, Polybutylene terephthalate, terephthalates, polyether imides, polyether sulfones, thermoplastic polyimides, thermoplastic polyurethanes, polyphenylene sulfides, polyethylene, polypropylene, polysulfones, polyvinylchlorides, styrene acrylonitriles, polystyrenes, polyphenylene, ether blends, styrene maleic anhydrides, polycarbonates, allyls, aminos, cyanates, epoxies, phenolics, unsaturated polyesters, bismaleimides, polyurethanes, silicones, vinylesters, urethane hybrids, polyphenylsulfones, copolymers of polyphenylsulfones with polyethersulfones or polysulfones, copolymers of poly-phenylsulfones with siloxanes, blends of polyphenylsulfones with polysiloxanes, poly(etherimide-siloxane) copolymers, blends of polyetherimides and polysiloxanes, and blends of polyetherimides and poly(etherimide-siloxane) copolymers.

10. The invention according to claim 5, wherein an angle formed between the groove and the skirt is between 40 and 140 degrees, between 80 and 110 degrees or between 85 and 95 degrees or about 90 degrees.

11. The invention according to claim 5, wherein the generally cylindrical neck comprises an interior neck positioned opposite the generally cylindrical neck and an interior shoulder connected to the interior neck extending opposite the shoulder, wherein an exterior shoulder angle is from the generally cylindrical neck to the shoulder and an interior shoulder angle is from the interior neck to the interior shoulder; and the interior shoulder angle is greater than the exterior shoulder angle.

12. The invention according to claim 1, wherein the interior shoulder further comprises a parallel region that is parallel to the exterior shoulder and a nonparallel region that is not parallel to the exterior shoulder.

13. The invention according to claim 5, wherein the interior shoulder further comprises a parallel region that is parallel to the exterior shoulder and a nonparallel region that is not parallel to the exterior shoulder.

14. The invention according to claim 1, wherein the nose is adapted to fit a 5.56 mm, 7.62 mm, 12.7 mm, 14.5 mm, .223, .243, .277, .300, .308, .338, or a .50 caliber projectile.

15. The invention according to claim 1, wherein the nose is adapted to connect to mate to a 5.56 mm, 7.62 mm, 12.7 mm, 14.5 mm, .223, .243, .277, .300, .308, .338, or a .50 caliber ammunition cartridge.

16. The invention according to claim 5, wherein the nose is adapted to fit a 5.56 mm, 7.62 mm, 12.7 mm, 14.5 mm, .223, .243, .277, .300, .308, .338, or a .50 caliber projectile.

17. The invention according to claim 5, wherein the nose is adapted to connect to mate to a 5.56 mm, 7.62 mm, 12.7 mm, 14.5 mm, .223, .243, .277, .300, .308, .338, or a .50 caliber ammunition cartridge.

* * * * *